US009551500B2

(12) United States Patent
Berben et al.

(10) Patent No.: US 9,551,500 B2
(45) Date of Patent: Jan. 24, 2017

(54) DEVICE FOR GENERATING AN AIR WALL

(75) Inventors: Ernest J. Berben, Poortvliet (NL); Peter J. Deweerdt, Erembodegem (BE)

(73) Assignee: HANDELSMAATSCHAPPIJ WILLY DEWEERDT BVBA, Kapelle (BE)

( * ) Notice: Subject to any disclaimer, the term of this patent is extended or adjusted under 35 U.S.C. 154(b) by 972 days.

(21) Appl. No.: 12/738,187

(22) PCT Filed: Oct. 16, 2008

(86) PCT No.: PCT/NL2008/050653
§ 371 (c)(1),
(2), (4) Date: Jul. 22, 2010

(87) PCT Pub. No.: WO2009/051482
PCT Pub. Date: Apr. 23, 2009

(65) Prior Publication Data

US 2010/0291856 A1 Nov. 18, 2010

(30) Foreign Application Priority Data

Oct. 16, 2007 (NL) ..... 2000942

(51) Int. Cl.
*F24F 9/00* (2006.01)
*F24F 3/16* (2006.01)

(52) U.S. Cl.
CPC ..... *F24F 9/00* (2013.01); *F24F 2003/1639* (2013.01)

(58) Field of Classification Search
CPC ..... F24F 9/00; F24F 3/1007; F24F 3/1607; F24C 15/20; F24D 23/023; F25D 23/023
(Continued)

(56) References Cited

U.S. PATENT DOCUMENTS 2,074,317 A * 3/1937 Allan et al. ..... 454/189
3,130,559 A 4/1964 Beckwith
(Continued)

FOREIGN PATENT DOCUMENTS

DE 12 79 697 B 10/1968
DE 199 32 708 A1 1/2001
(Continued)

OTHER PUBLICATIONS

Vedavarz, Ali; Kumar, Sunil; Hussain ,Muhammed Iqbal. HVAC—The Handbook of Heating, Ventilation and Air Conditioning for Design and Implementation. Industrial Press. 2007 (Chapter 8).*

*Primary Examiner* — Avinash Savani
*Assistant Examiner* — Vivek Shirsat
(74) *Attorney, Agent, or Firm* — Stein IP, LLC

(57) ABSTRACT

A device for generating an air wall comprises a primary blower slit for generating a flat primary air stream in a passage opening mutually separating two spaces with different temperatures. Two adjacent air streams with the same direction and speed are added to the primary air stream. The primary air stream has a temperature between those of the secondary air streams. The absolute humidity of the air of the primary air stream is at least equal to that of the cold secondary air stream and lower than that of the warm secondary air stream. The air speed of the primary air stream amounts to at least 15 m/s. The width of the primary blower slit lies in the range of 15-40 mm. The length of the primary blower slit in the direction of the air stream lies roughly in the range of 5-40 cm, preferably 10-30 cm. No mixing occurs hereby occurs between the primary air stream Sp and the second secondary air stream Ss2 on the side of the warm space, whereby condensation (misting and vaporization) and/or sublimation (icing) is prevented.

14 Claims, 26 Drawing Sheets

(58) Field of Classification Search
USPC ..... 454/188, 191, 192, 190
See application file for complete search history.

(56) References Cited

U.S. PATENT DOCUMENTS

| | | | | |
|---|---|---|---|---|
| 3,143,952 | A * | 8/1964 | Simons | F24F 9/00 454/190 |
| 3,233,423 | A | 2/1966 | Beckwith et al. | |
| 3,304,736 | A | 2/1967 | Brennan et al. | |
| 3,362,469 | A * | 1/1968 | Berner et al. | 165/122 |
| 3,363,533 | A | 1/1968 | Tamm | |
| 3,365,908 | A | 1/1968 | MacMaster | |
| 3,394,755 | A * | 7/1968 | Morrison | 165/103 |
| 3,403,626 | A | 10/1968 | Beckwith et al. | |
| 4,144,720 | A | 3/1979 | Subera et al. | |
| 4,148,197 | A | 4/1979 | Karashima | |
| 4,326,385 | A | 4/1982 | Ibrahim | |
| 5,195,888 | A * | 3/1993 | Sharma et al. | 432/64 |
| 7,819,729 | B2 | 10/2010 | Rohrer et al. | |
| 8,287,337 | B2 * | 10/2012 | Smith et al. | 454/188 |
| 2004/0003617 | A1 | 1/2004 | Chandler | |
| 2005/0138943 | A1 | 6/2005 | Alahyari | |
| 2005/0197057 | A1 * | 9/2005 | Rohrer et al. | 454/191 |

FOREIGN PATENT DOCUMENTS

| | | | |
|---|---|---|---|
| DE | 103 20 490 | A1 | 10/2004 |
| EP | 0 447 314 | A | 9/1991 |
| EP | 0 645 588 | A | 3/1995 |
| EP | 1 217 317 | A | 6/2002 |
| FR | 2 757 933 | A | 7/1998 |
| GB | 481 991 | A | 3/1938 |
| NL | 1 024 346 | C2 | 3/2005 |
| SE | 9700505 | A | 8/1998 |
| WO | WO 2006/115824 | A3 | 11/2006 |

* cited by examiner

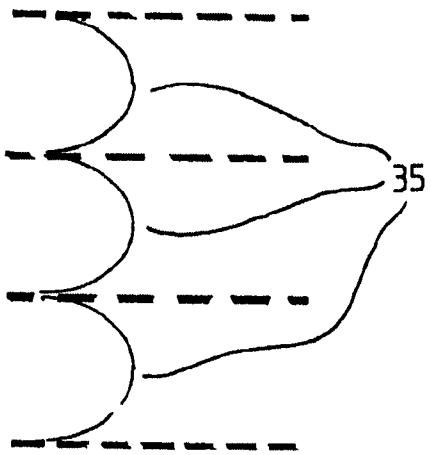
fig. 5D
fig. 6D
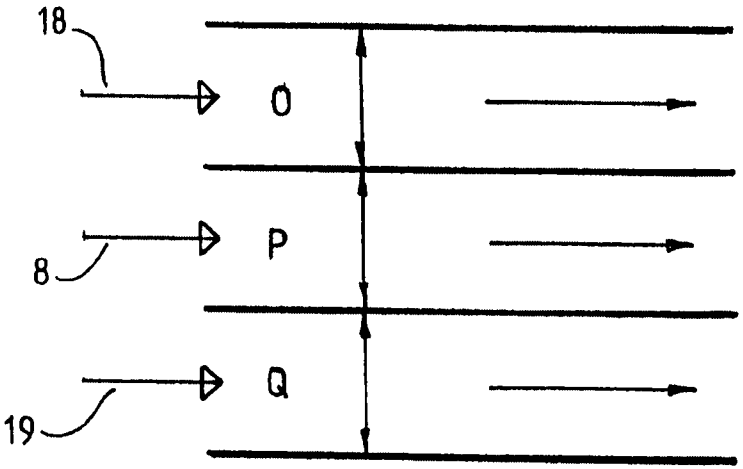
fig. 5B
fig. 6B

DEVICE FOR GENERATING AN AIR WALL

CROSS REFERENCE TO RELATED APPLICATIONS

This application is a National Phase filing under 35 U.S.C. §371 of PCT/NL2008/050653 filed Oct. 16, 2008, which claims priority to Patent Application No. 2000942, filed in Netherlands on Oct. 16, 2007. The entire contents of each of the above-applications are incorporated herein by reference.

The invention relates to a device for generating an air wall for thermal separation of the air in a first relatively cold space from the air in a second relatively warm space, which spaces are mutually connected by a passage opening, the device comprising:

a primary blower unit positioned on one side of the passage opening and having primary blower fan means and a primary blower slit which connects thereto on the blower side, is disposed substantially parallel to the main plane of the passage opening and extends over the whole relevant dimension of the passage opening for the purpose of generating an at least more or less flat primary air stream directed at least roughly toward the opposite side of the passage opening.

Such an air wall is generally known and usual, for instance for thermal separation of the cold air in a cold store from the relatively warm air in a space connecting thereto, for instance the outside air.

Such a device is often embodied such that transport vehicles, for instance fork-lift trucks or other means of transport, are able to pass through. For this purpose the primary blower slit can for instance be positioned on one side of a usually rectangular passage opening. Also known is the use of a blower slit which connects to the upper edge of the opening. In both cases vehicles can travel across the floor and pass through the air wall without obstruction.

A device of the type stated in the preamble is for instance known from U.S. Pat. No. 6,106,387. This document describes a technique which cannot prevent the formation of mist in the passage opening and icing on, among other parts, the floor of the cold store. Both phenomena can result in hazardous situations. In addition, the known device is not very effective. In the case of for instance a cold store with a temperature of −20° C. a temperature of 25° C. must for instance be bridged relative to the temperature of +5° C. in the outside space. This involves the prerequisite of a high degree of sealing of the passage opening by the air wall. The device according to this American patent cannot meet this requirement of practically complete sealing of the air wall.

A device as described in U.S. Pat. No. 3,143,952 also has the stated drawbacks.

In respect of the above the invention provides a device of the type stated in the preamble, which device has the feature that two secondary air streams Ss1 and Ss2 are added to the primary air stream Sp on either side thereof, which secondary air streams have substantially the same direction as the primary air stream;

$Ts1<Tp<Ts2$, wherein:

Ts1=the temperature of the secondary air stream on the side of the relatively cold space, Tp=the temperature of the primary air stream, and Ts2=the temperature of the secondary air stream on the side of the relatively warm space;

$AVs1 \leq AVp<AVs2$, wherein:

AVs1=the absolute humidity of the air of the secondary air stream on the side of the relatively cold space, AVp=the absolute humidity of the air of the primary air stream, and AVs2=the absolute humidity of the air in the secondary air stream on the side of the relatively warm space;

the speed of the air in the primary air stream amounts to at least 15 m/s; and the width of the primary blower slit lies in the range of 15-40 mm; and the length of the primary blower slit in the direction of the air stream lies roughly in the range of 5-40 cm, preferably 10-30 cm, this such that negligible mixing occurs between the primary air stream Sp and the two secondary air streams Ss1 and Ss2, whereby condensation (misting and vaporization) and/or sublimation (icing) is prevented.

A great advantage of the air wall device according to the invention is that the air stream, which is very thin compared to the prior art and which has a high flow speed, effectively has a high degree of "stiffness". Owing to the high momentum content of this flow it is therefore not easy to disrupt the flow. In known air walls or air curtains a flow can easily be displaced out of its nominal path, for instance by suddenly occurring pressure differences as can occur in the case of varying wind loads on the associated outer wall. As a result the highly undesirable phenomenon can occur that the air wall no longer acts to seal the passage opening, or at least does so in greatly worsened manner. This can effectively result in misting, icing on floors, a higher energy consumption and a dramatically reduced quality of the air wall in general. Owing to the property of the air wall according to the invention referred to as "stiffness" this undesirable phenomenon of the air wall being blown away will occur considerably less.

Attention is further drawn to the fact that, as a result of the high flow speed in the primary air stream of the air wall, a stationary heat-transfer situation cannot occur in the air wall, as is the case at relatively low flow speeds. Effective mixing and heat diffusion between the warm and cold sides adjacently of the air wall is in fact effectively precluded. This is manifested in a property which could be described as an effectively extremely high heat resistance. It is thus possible for instance to envisage a separation between an outside temperature of for instance +5° C. and a temperature in a cold store of −20° C. This temperature difference is effectively bridged by an air wall according to the invention with a thickness of for instance 25 mm, with a negligible heat transfer between the outside air and the inside air.

Surprisingly, it has been determined that, despite the relatively high air speeds occurring in the air wall according to the invention, an observer passing through the air wall perceives the associated flow according to the invention to a considerably lesser extent than the relatively wide prior art air curtains, for instance with a width in the order of 10-30 cm, in which the air speed is considerably lower.

It is also noted here that in the air wall device according to the invention the infeed pressure in the primary blower slit is considerably higher than that according to the prior art, and that the flow speed of the air will thereby be substantially higher. Since the width of the blower air slit will however be substantially smaller than that according to the prior art, the overall airflow according to the invention is smaller. It is therefore possible to conclude that, using very simple means according to the invention, the efficiency, also the thermal efficiency, of the device according to the invention is better than that according to the prior art.

In a preferred embodiment the device according to the invention has the special feature that the primary blower unit comprises a cavity to which the primary blower slit connects.

In a specific embodiment this embodiment has the special feature that the cavity has an at least more or less prismatic form, i.e. a form having the same cross-sectional form at any axial position.

The device can be particularly embodied such that the cross-sectional area of the cavity lies in the range of about 400 $cm^2$ for relatively low airflow speeds to about 2000 $cm^2$ for relatively high airflow speeds.

It is important that the cavity has a form such that turbulences are essentially prevented. Use can be made for this purpose of an at least slightly smooth, rounded form. Use can also be made of a form in which the dimensions in two independent directions are roughly in the same order of magnitude, or a faceted form in which the angle between adjacent facets amounts to at least 90°.

It is noted that the cavity can in all probability be deemed a pressure buffer into which air under pressure is admitted, the air under pressure is distributed and subsequently blown out through the relatively narrow blower slit.

Recommended is a variant in which the speed of the air in the primary air stream amounts to at least 20 m/s.

The device still more preferably has the special feature that the speed of the air in the primary air stream amounts to at least 30 m/s.

According to a further preferred aspect, the device has the feature that the width of the primary blower slit lies in the range of 18-30 mm.

In a specific embodiment the device comprises a suction unit positioned on the opposite side of the passage opening and having a for instance substantially prismatic suction slit extending substantially parallel to the blower slit and having substantially the same length as the primary blower slit, to which suction slit connect suction fan means. It is noted that such a suction unit with suction slit is per se known from the two stated references.

A practical embodiment has the special feature that the primary blower slit is connected via a duct to the suction slit, in which duct fan means are disposed which are both the primary blower fan means and the suction fan means. It is noted that this structure is per se known from the two stated publications. Not known however is the specific choice of the relationships between the temperatures and the absolute humidities in the primary air stream and the secondary air flow.

It is further noted that an air curtain device is known from DE-A-199 32 708 in which use is made of air speeds of an air curtain flow of 5-35 m/s. It is however deemed essential according to the invention that the width of the primary blower slit lies in the range of 15-40 mm, preferably of 18-30 mm, and the length of the primary blower slit in the direction of the air stream lies roughly in the range of 5-40 cm and preferably roughly in the range of 10-30 cm. This significant dimensioning is not known from the stated reference.

Very simple is an embodiment in which at least one of the secondary air streams is an entrained air stream.

Somewhat more complicated, although often easier to control in some conditions, is an embodiment in which at least one of the secondary air streams is actively generated by a secondary blower unit with secondary blower fan means and a secondary blower slit which connects thereto on the blower side, is disposed adjacently of the primary blower slit and has substantially the same length as the primary blower slit.

It is noted that from DE-A-103 20 490 a device is known for generating an air curtain which is adapted to generate a primary air stream and a flanking, secondary air stream. No further characterizing parts of the present invention are known from this publication.

NL-C-1024346 discloses a device for generating an air curtain comprising a primary air stream and two flanking, secondary air streams, likewise with no mention of any further characterizing part of the present invention.

Subject to the conditions of the air streams in contact with each other, condensation and icing may for instance occur. In order to prevent this undesirable phenomenon use can be made of an embodiment in which the temperature and/or the humidity of the air blown out by a secondary blower unit is changed.

An embodiment with a primary blower slit and a secondary blower slit is preferably embodied such that the primary blower slit and the secondary blower slit are spaced by a maximum of about 3 mm, preferably 2 mm.

According to yet another preferred aspect according to the invention, the device has the special feature that the suction slit has a width and is disposed such that it suctions substantially only the primary air stream Sp. Hereby realized is that the or each secondary air stream remains situated only in the relevant space or the outside air. The effectiveness of the air wall according to the invention is hereby not affected, although the efficiency of the device is hereby maintained at a high level.

According to a specific aspect of the invention, the device has the special feature that a catching unit for ice crystals is placed in the downstream zone of the primary outflow.

This latter embodiment can for instance be embodied such that the catching unit comprises a filter with gauze, the mesh width of which amounts for instance to 0.4-2 mm, preferably 0.6-1.4 mm.

In order to enable easy and effective cleaning of this filter, the device can be embodied such that the filter is disposed at least more or less vertically and a cleaning device is added to the filter, for instance a brushing device or an impact excitation device, through activation of which the filter undergoes an impact, for instance in its main plane, whereby the ice accumulated against the filter releases from the filter.

It will be apparent that it is of the greatest importance that the air curtain according to the invention completely seals and keeps sealed the passage opening, certainly in stationary, relatively calm conditions. The lowest part of the air stream must be prevented from undergoing a speed reduction, due to the divergent character inherent thereto, such that there is a danger that the air in this lowest zone begins to move upward in a path which is to some extent curved, thereby creating a non-sealed corner. It is noted that, as a result of the relatively high flow speeds of the air in the air wall according to the invention, this phenomenon will not take on dramatic forms, although it is nevertheless recommended according to the invention that it be at least substantially wholly precluded.

In this respect the invention also provides a device in which a row of control valves, distributed along the height and for instance of the passive type, is added to a vertical suction slit for a substantially constantly passing airflow such that the same flow passes at each height position, such that the air in the relevant air stream flows substantially horizontally at any height.

Passive control valves which ensure that the passing airflow is always constant are per se known and are commercially available from, among others, the French firms Aldes and Enjos.

Surprisingly, it has been found that by disposing these constant flow valves substantially connecting to each other over the whole height of the vertical suction slit the suction is automatically adjusted at each level by the passive control valves such that the valves placed lower down also ensure a sufficient air stream, whereby the air stream can also be wholly horizontal in the lowermost zone of the air curtain. This effectively prevents an inactive bottom corner occurring on the side of the suction slit.

Very practical is an embodiment in which the device is embodied as a generally tubular, hollow portal, with the general form of a downward opening U which can be added or has been added to the passage opening and the one leg of which has a blower slit and the other leg a suction slit. A device of this type is suitable for adding to an existing entrance opening. With such a device an existing cold store for instance can therefore be provided with an air wall device according to the invention.

A practical and simple embodiment of this latter type has the special feature that fan means are present in the hollow portal in the air circuit between the slits.

The device with a cavity present in the primary blower unit is preferably embodied such that the blower slit connects to the cavity present in the blower unit via a for instance substantially prismatic, narrowing transition zone. Such a cavity can also be used for at least one secondary air stream. It can be noted in general that the blower units for the primary and the secondary air streams can have largely the same construction. Depending on the desired setting, the dimensioning between the primary and the secondary units can also differ to some extent.

An embodiment with a suction unit preferably has the special feature that the suction slit connects to a suction opening which has a form narrowing from the outside to the inside.

In a specific aspect of the invention the device has the feature that on the side remote from the primary blower unit a second, for instance substantially prismatic blower unit is positioned which has a height roughly corresponding to the height of passing vehicles, which second blower unit is set into operation when a vehicle approaches and which is rendered inoperative after the vehicle has wholly passed through the area of the passage opening. Using such an embodiment the effectiveness of the air curtain is maintained when a vehicle passes through.

According to yet another aspect of the invention, the device has the feature that filter means for cleaning suctioned air are added to the suction unit.

In order to be able to ensure that the device can be modified to changing conditions, for instance changes between winter and summer conditions, the device can have the special feature that the width of a blower slit is adjustable.

Finally, the invention relates to an assembly of at least two devices in accordance with any of the above described aspects according to the invention, which assembly is disposed in a transit tunnel which connects sealingly to the passage opening, in which assembly adjacent primary air streams have opposing directions.

The invention will now be elucidated with reference to the accompanying drawings of a number of different exemplary embodiments and partial aspects according to the invention, to which the invention is not limited.

Figure 4:
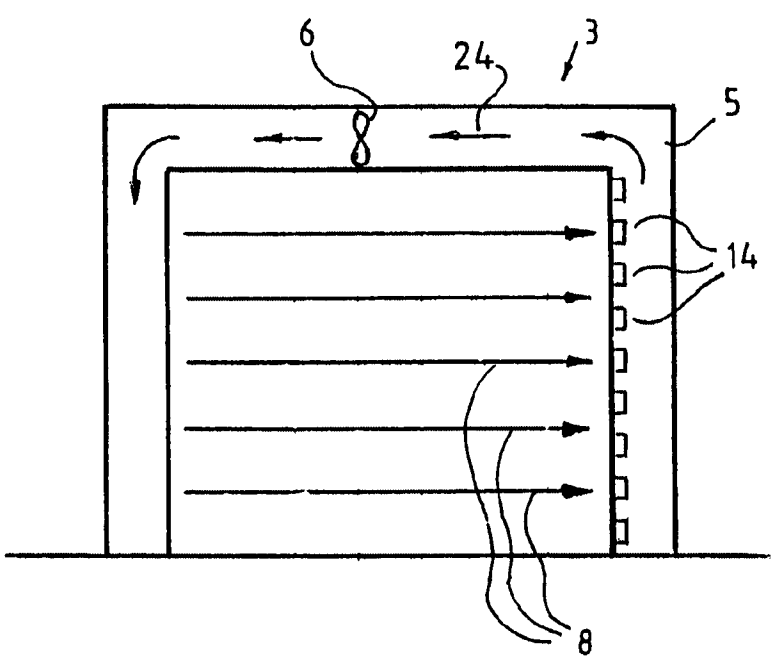
FIG. 4 shows a schematic view corresponding with FIG. 3 of an embodiment according to the invention, in which the stated problem has been wholly solved.
Figure 5:
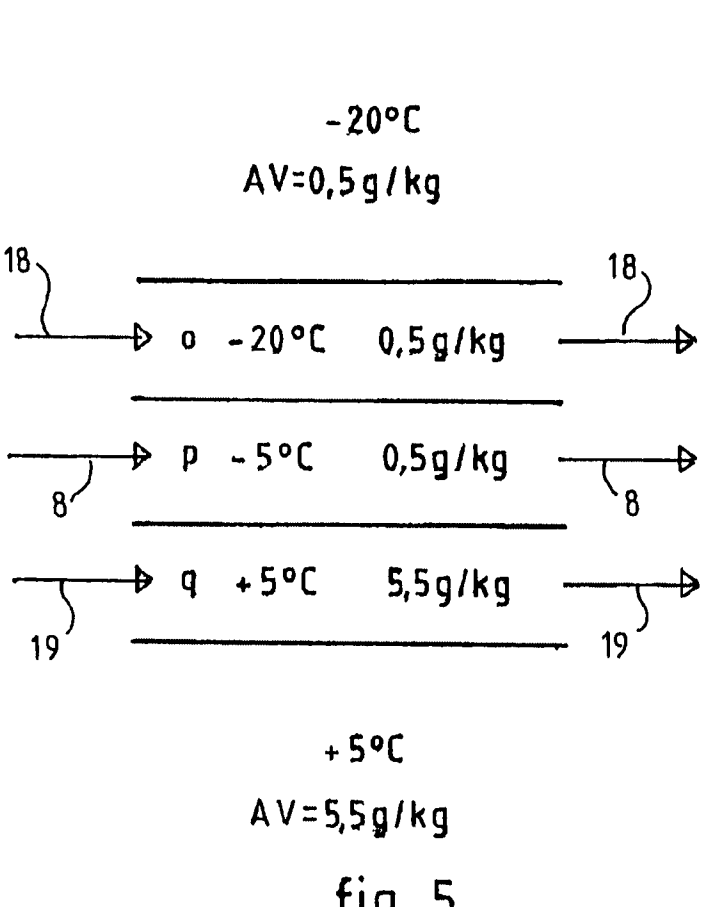
Figure 5A:
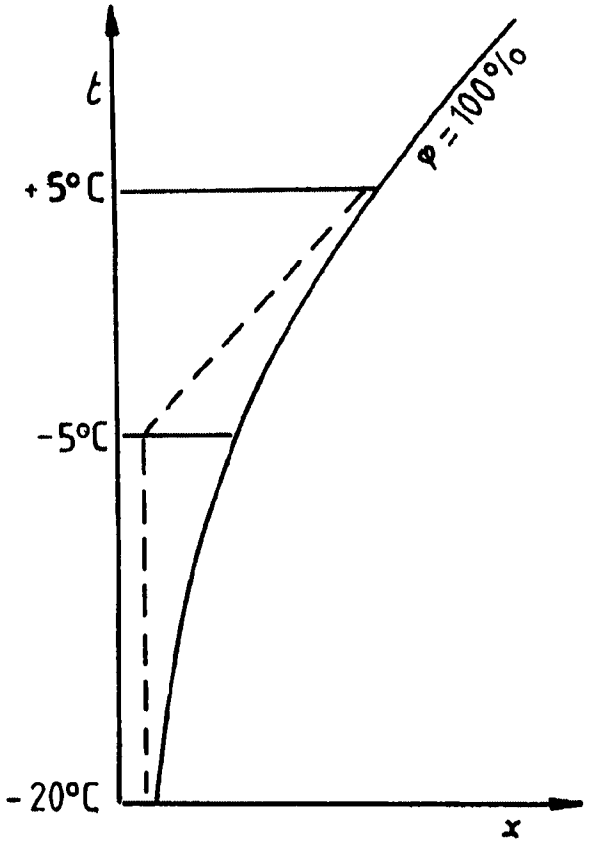
Figures 5C, 6C:
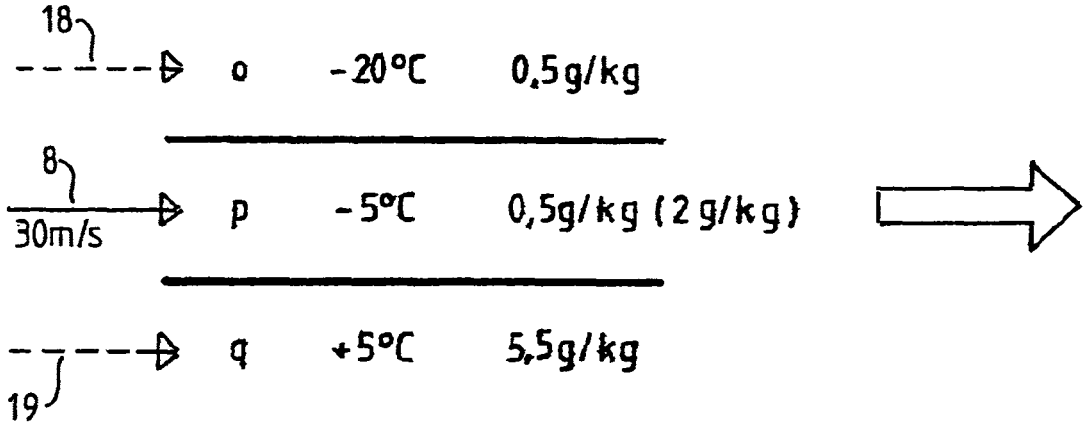
Figure 7:
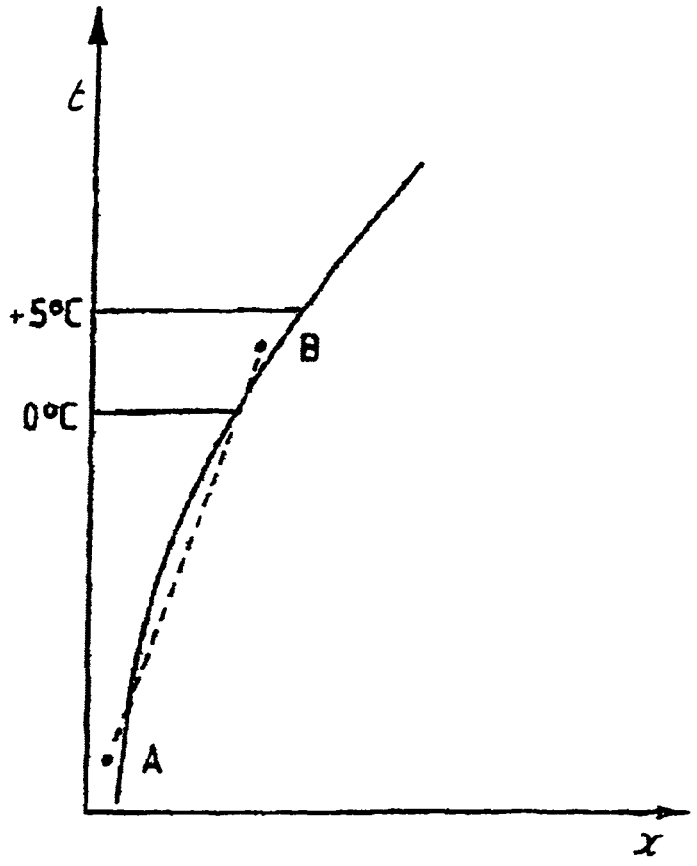
Figure 8:
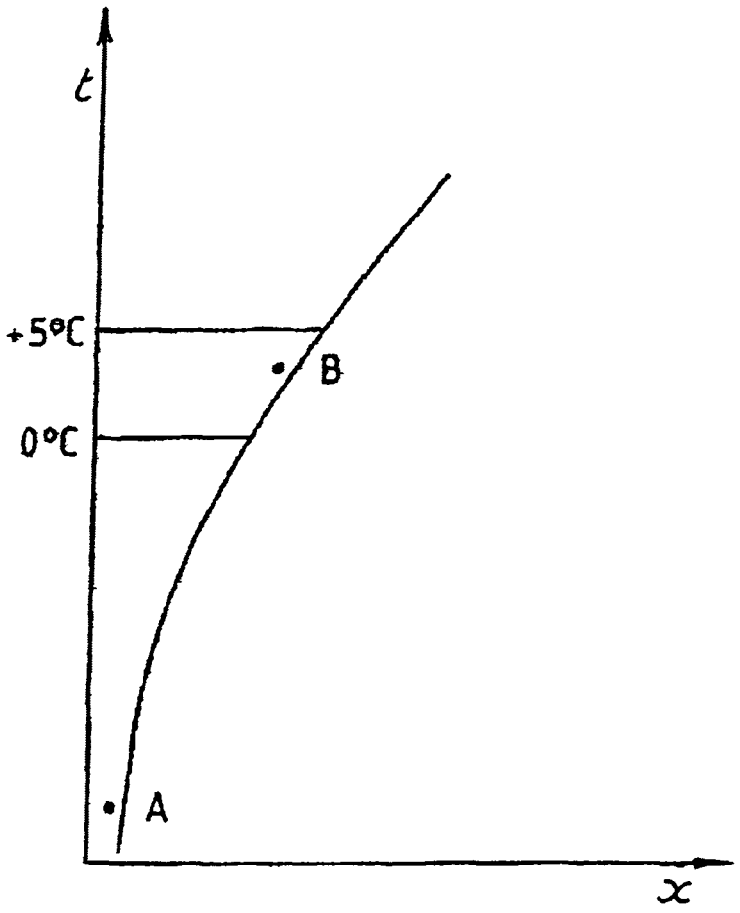
Figure 9:
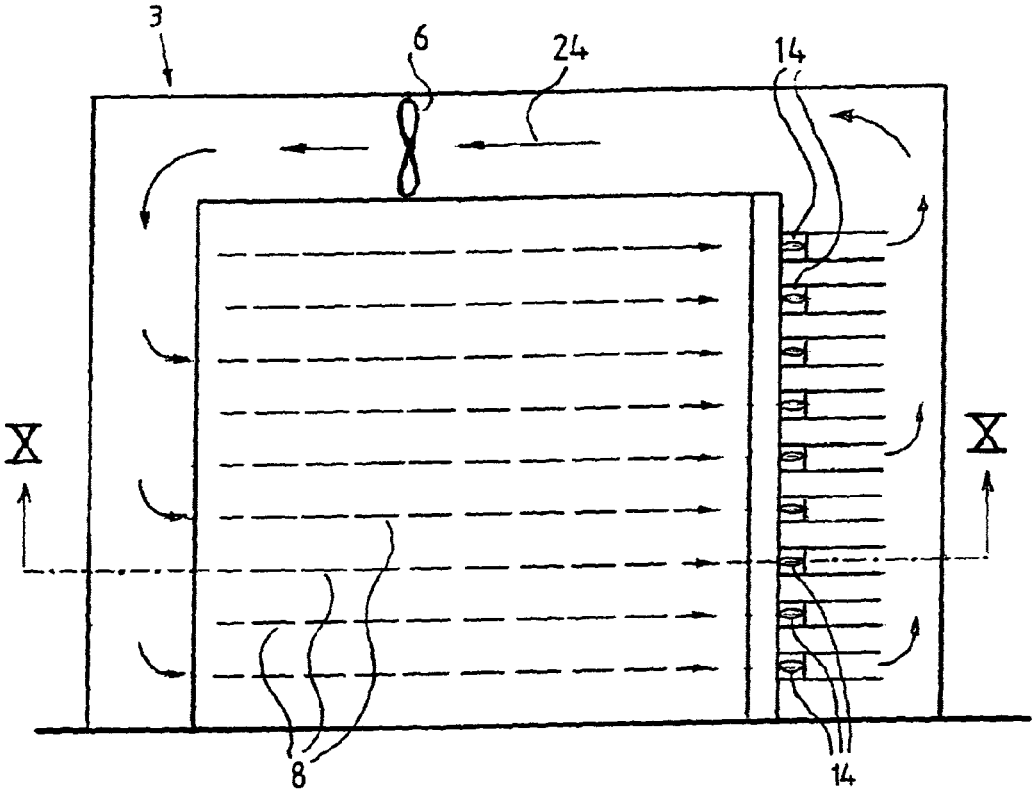
Figure 10:
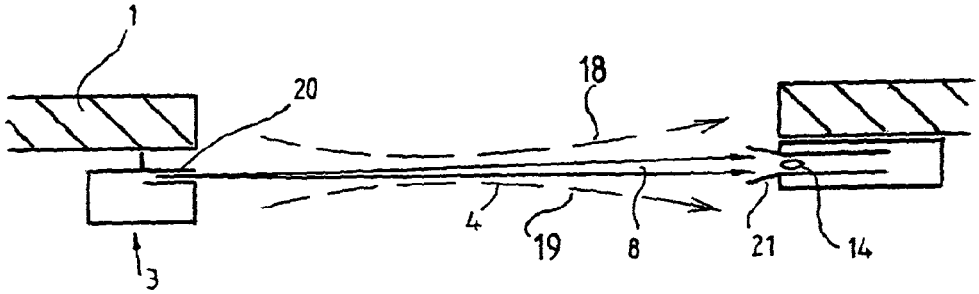
Figure 11:
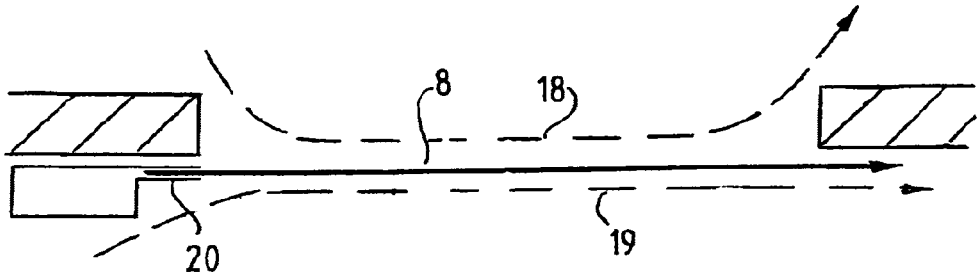
Figure 12:
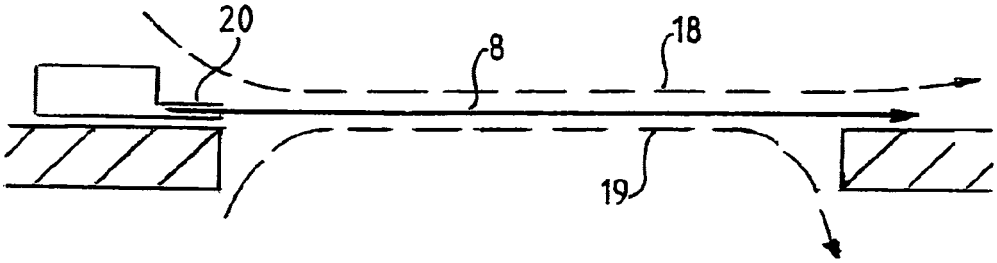
Figure 13:
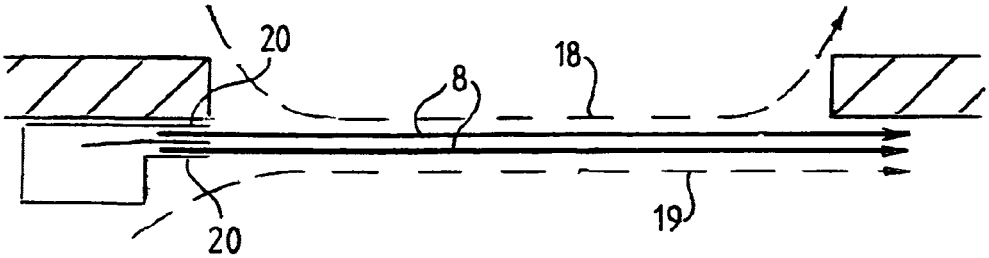
Figure 14:
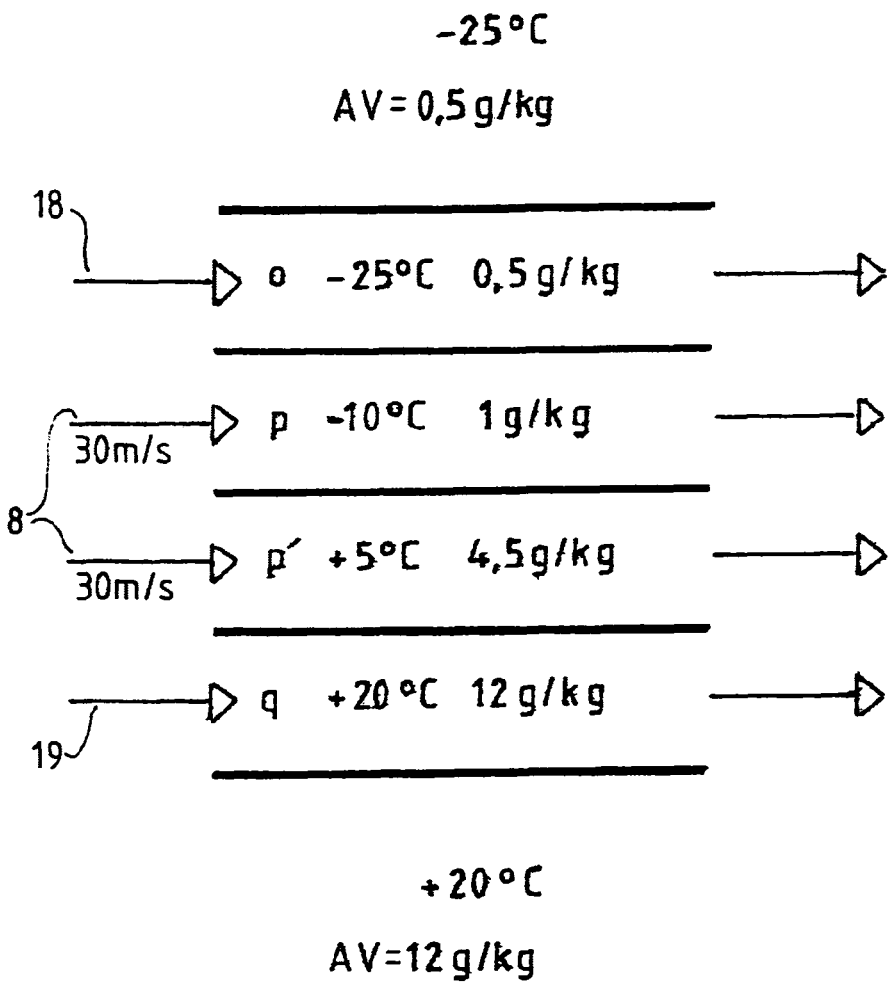
Figure 14A:
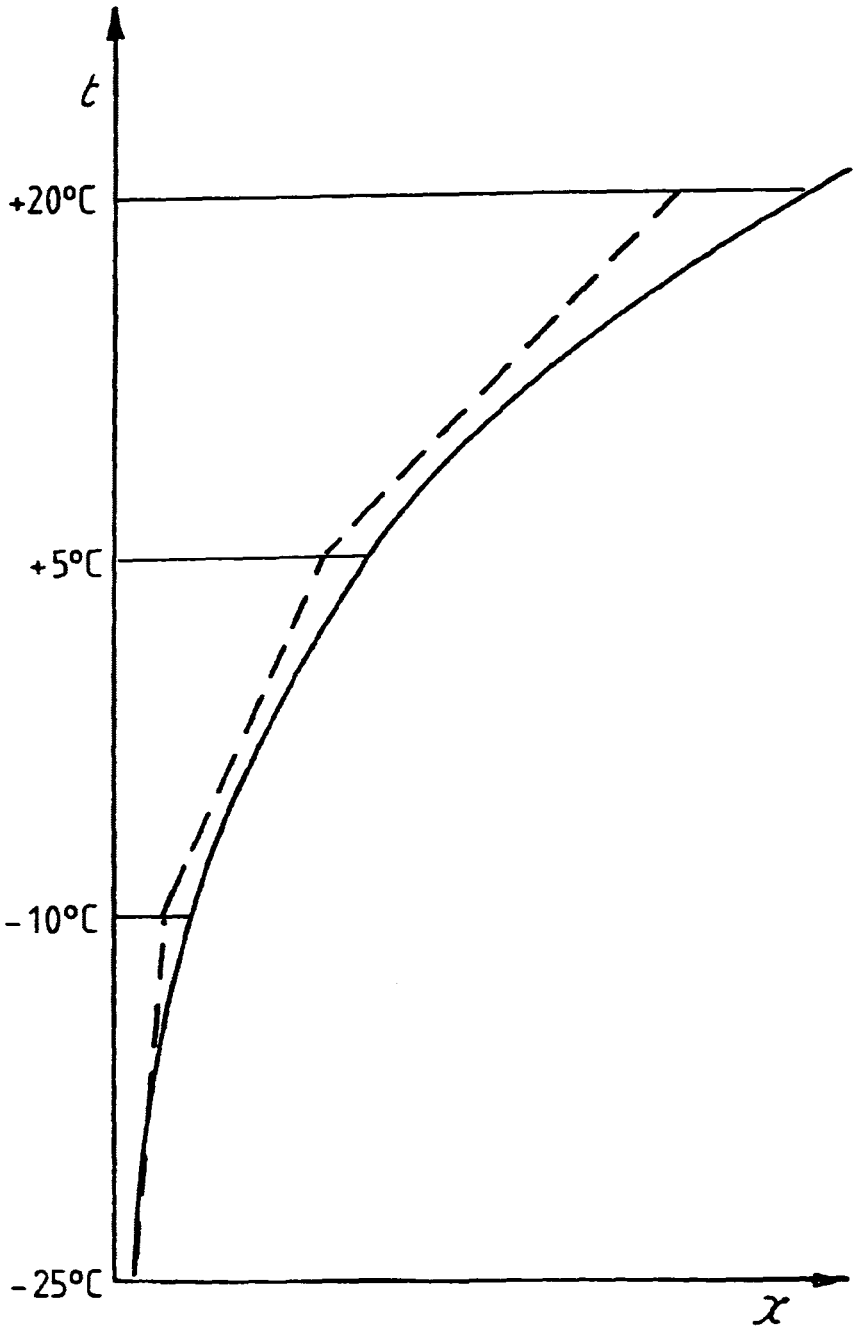
Figure 14B:
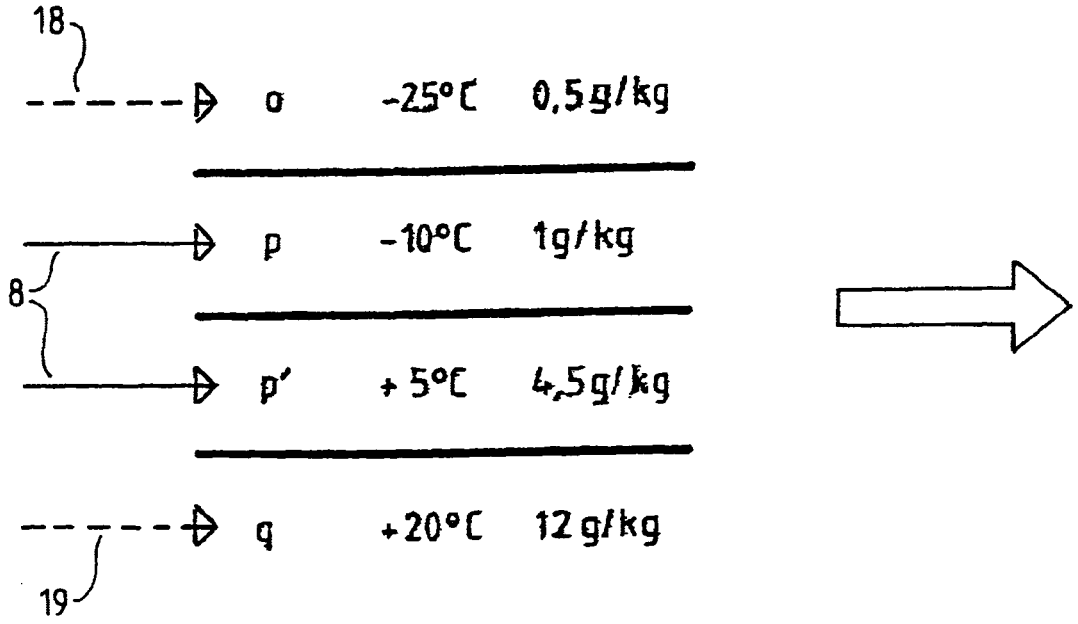
Figure 15A:
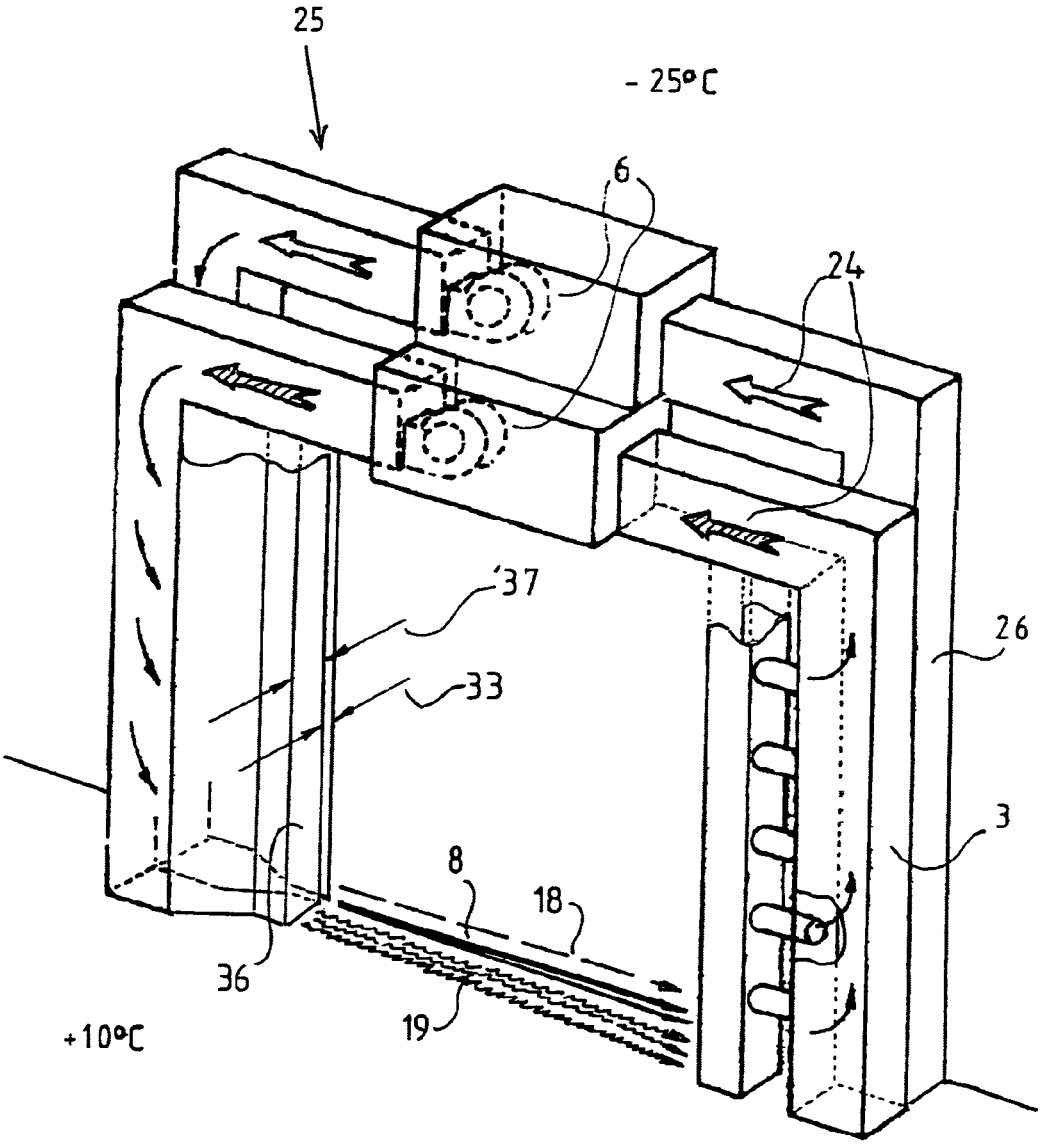
Figure 15B:
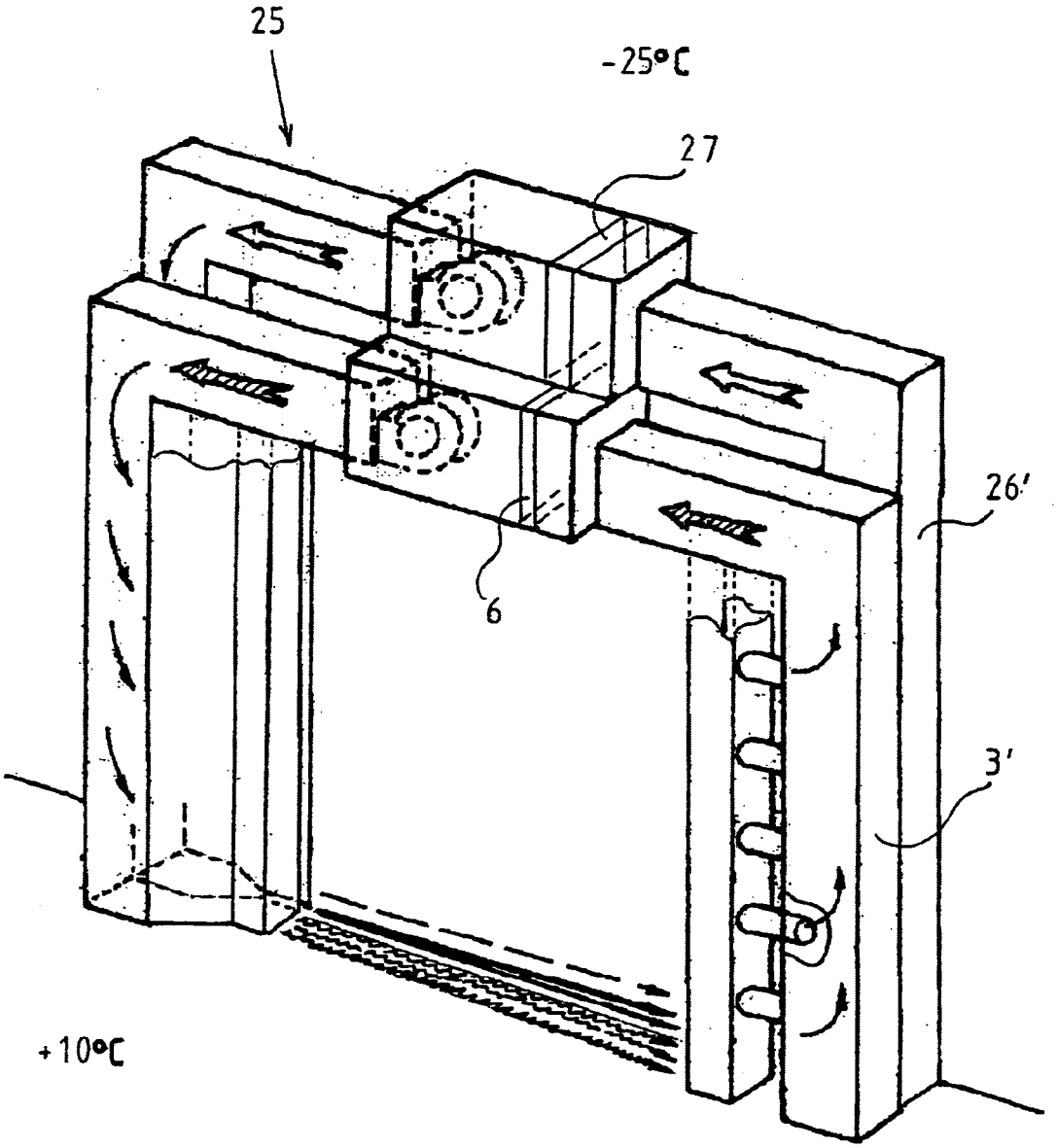
Figure 16:
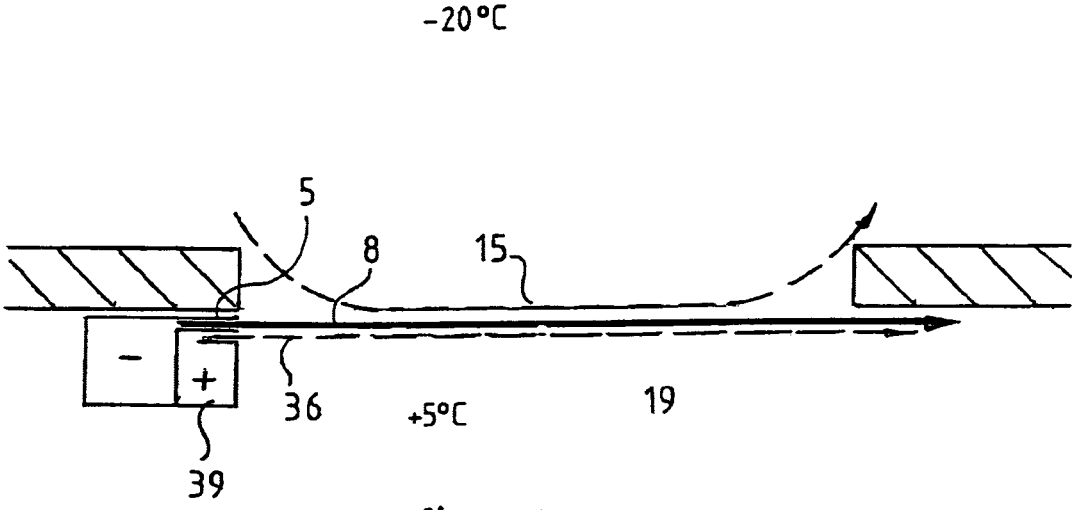
Figure 17:
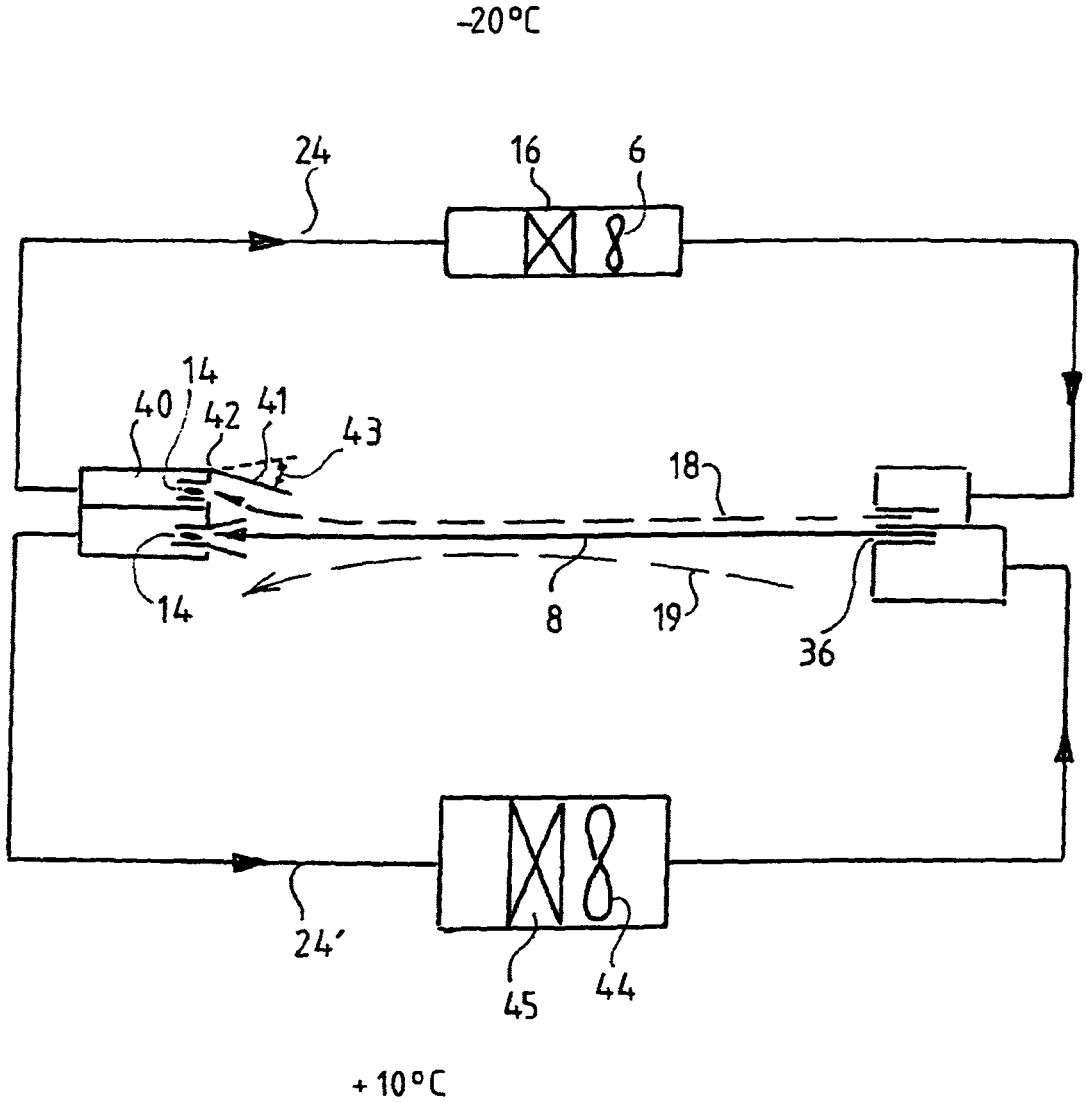
Figure 18:
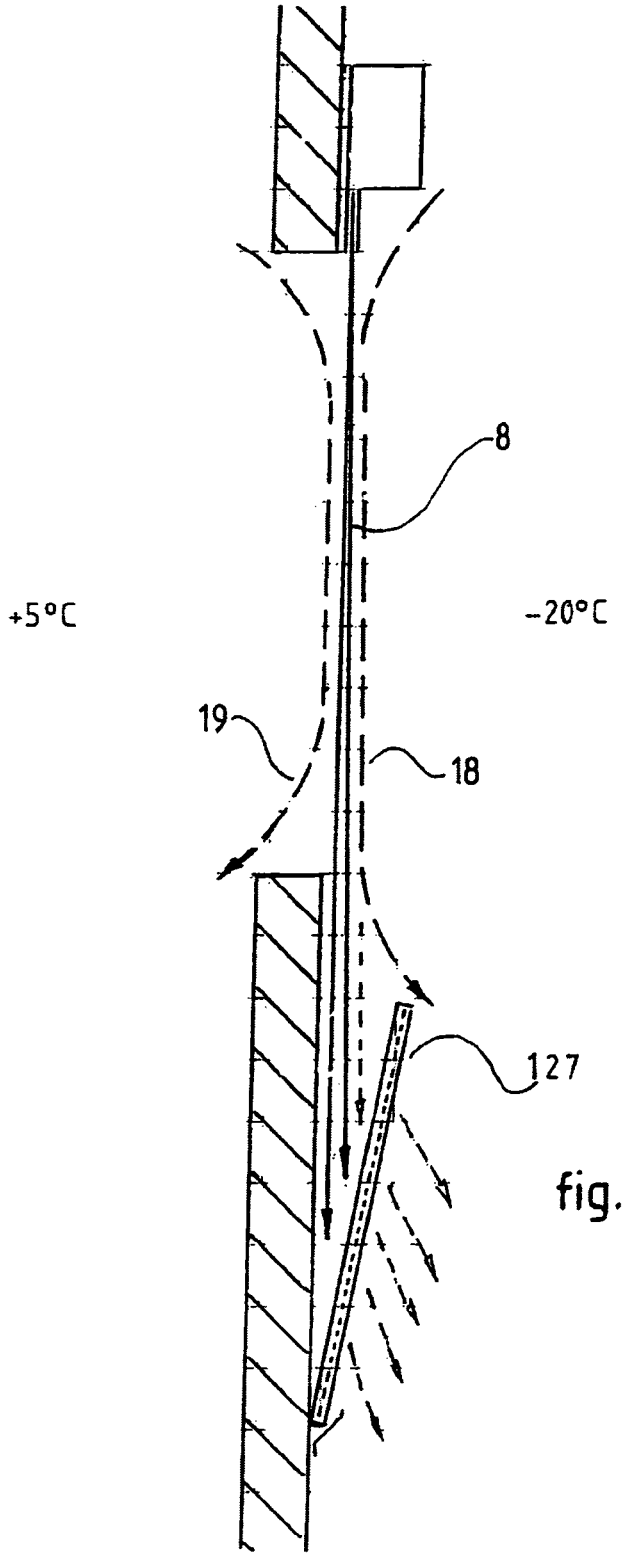
Figure 19:
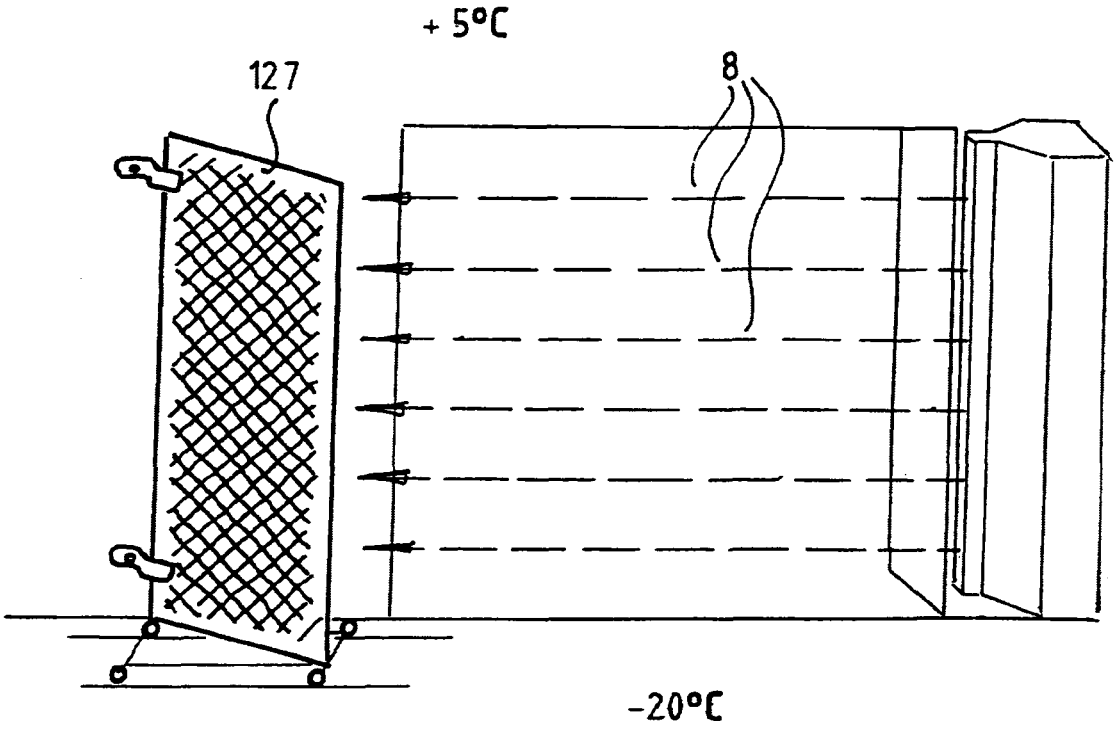
Figure 20:
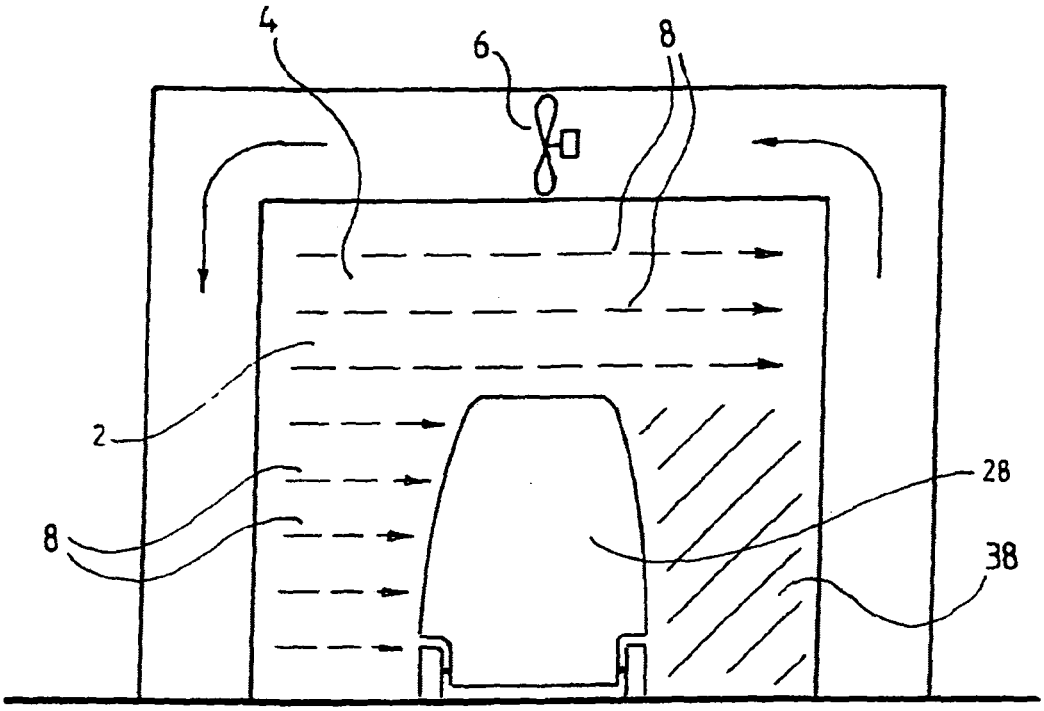
Figure 21:
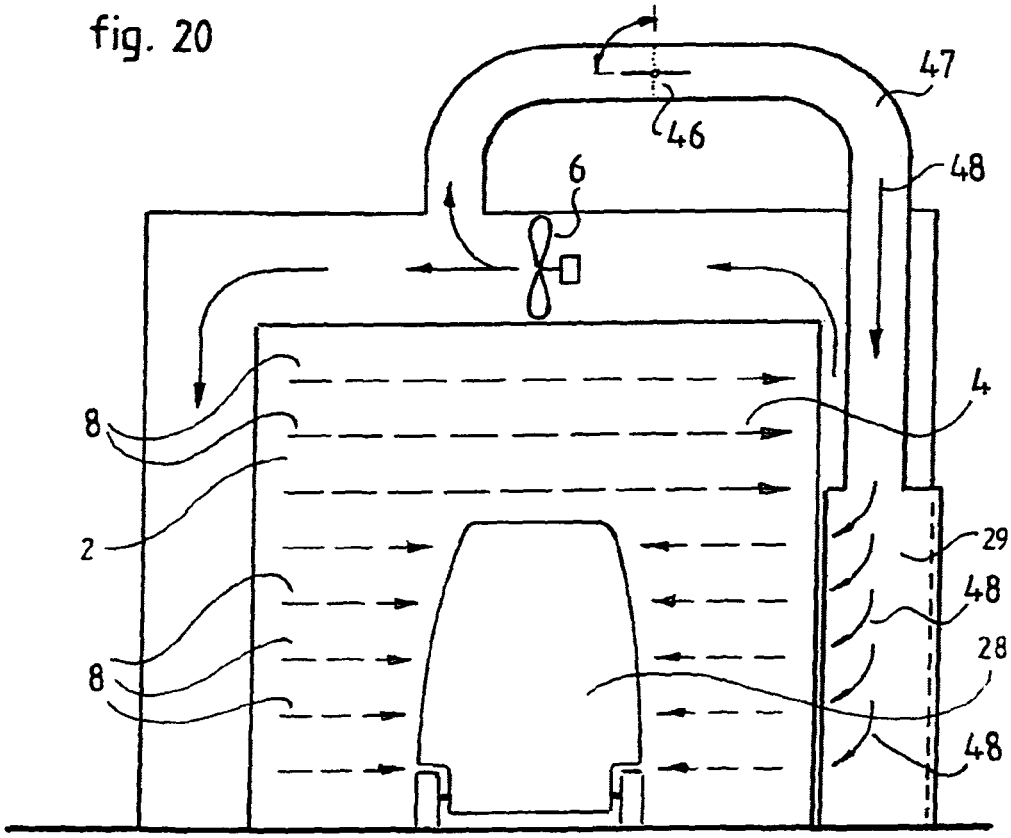
Figure 22A:
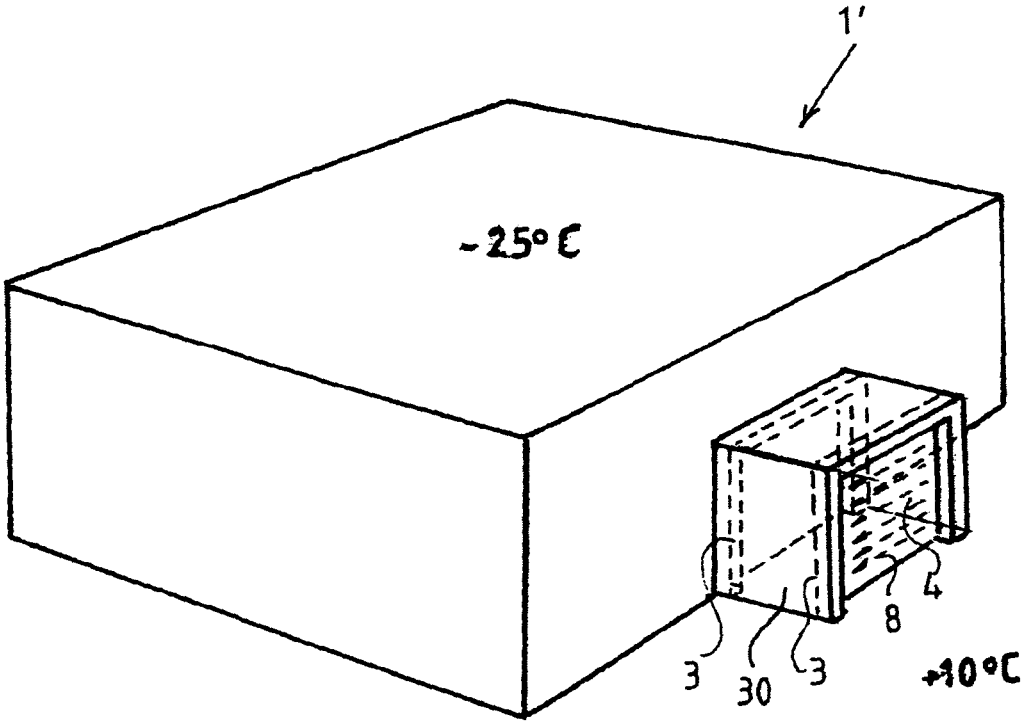
Figure 22B:
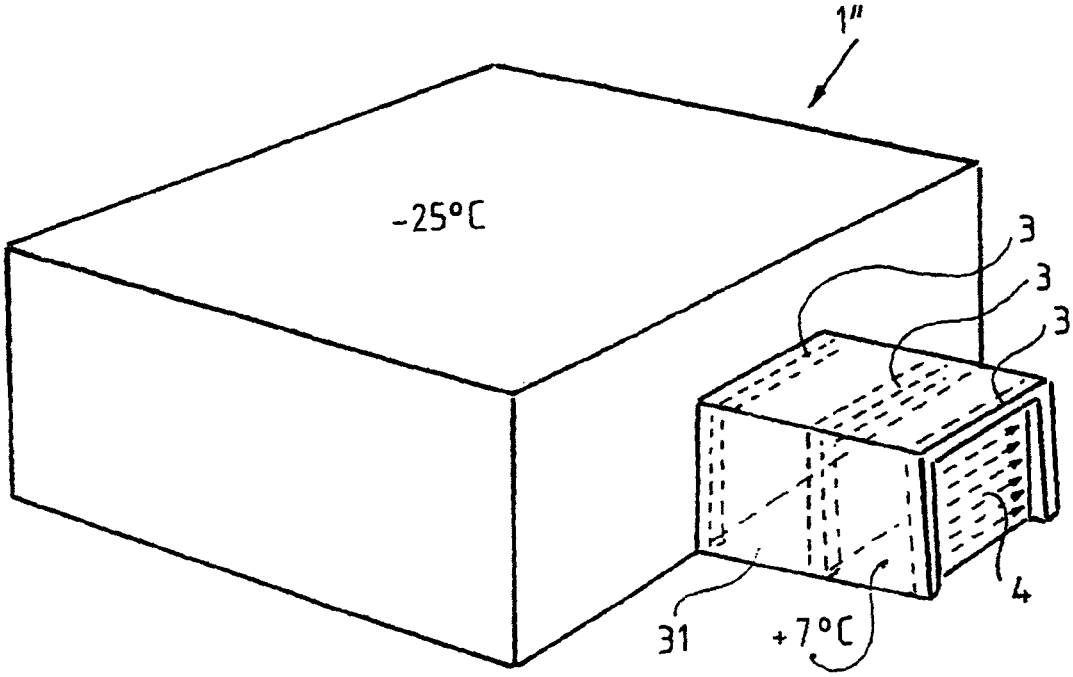
Figure 23:
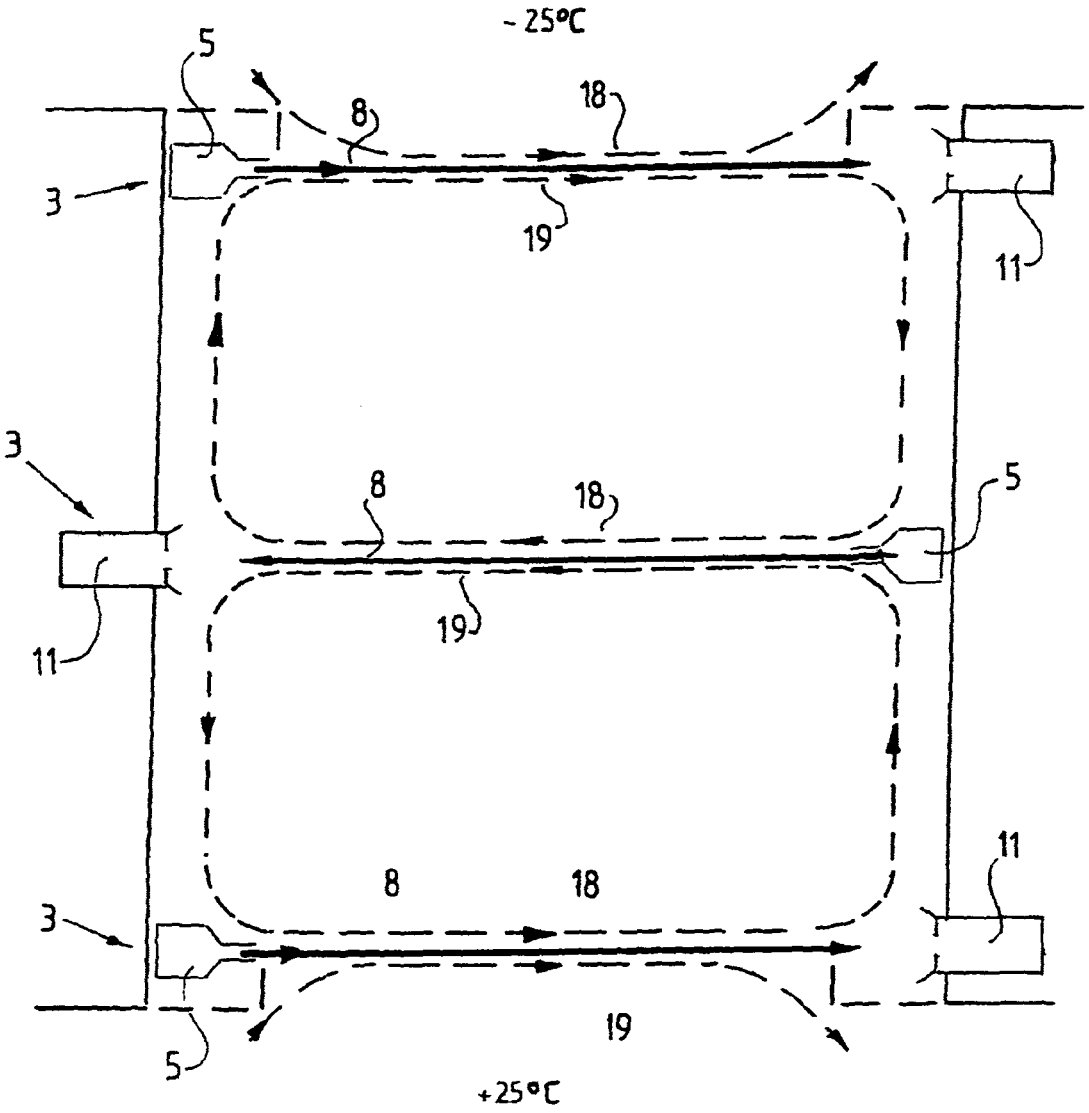
Figure 24A:
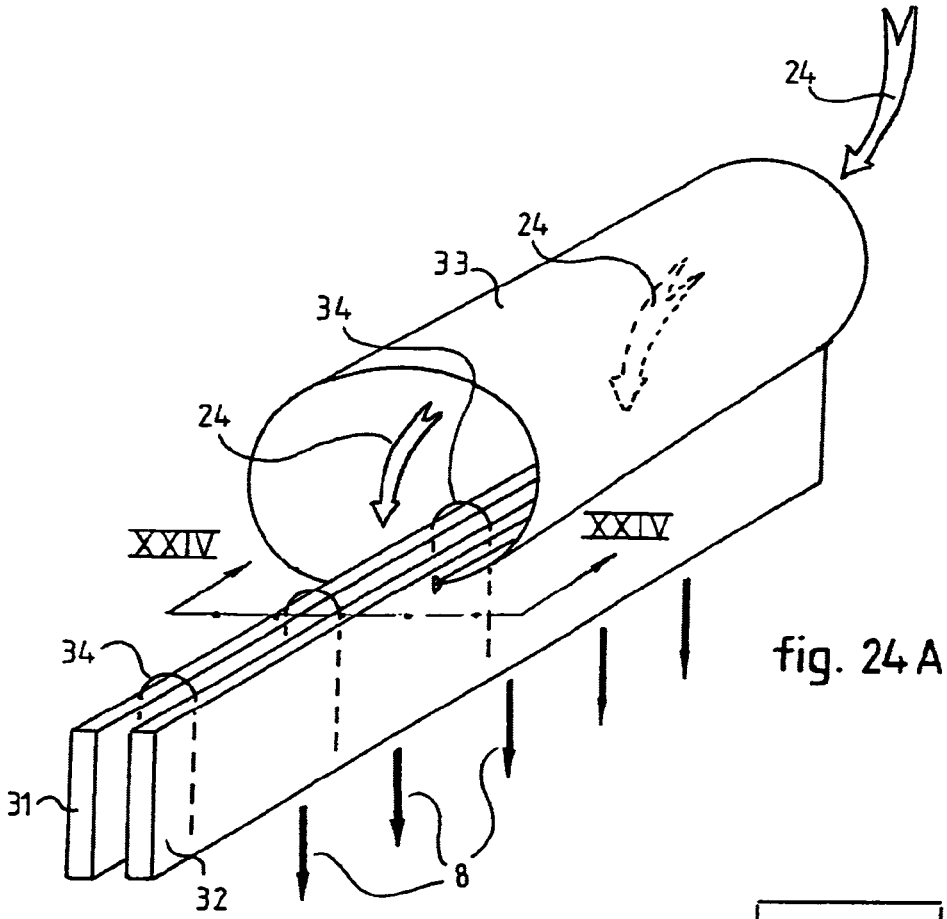
Figure 24B:
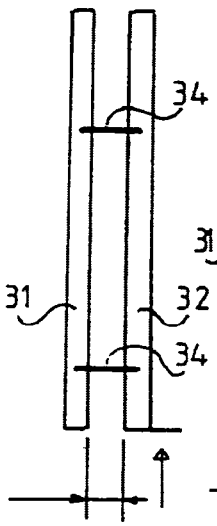
Figure 24C:
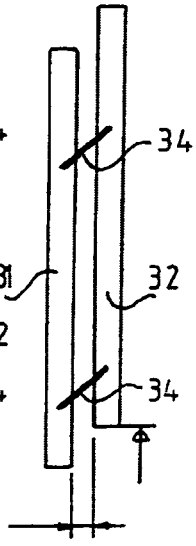
Figure 24D:
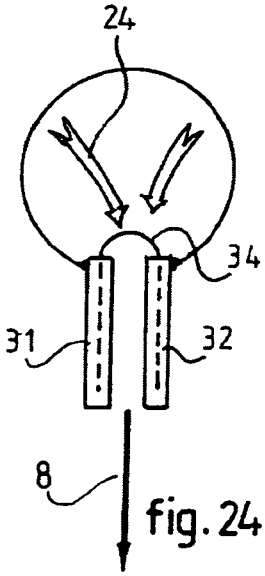
Figure 24E:
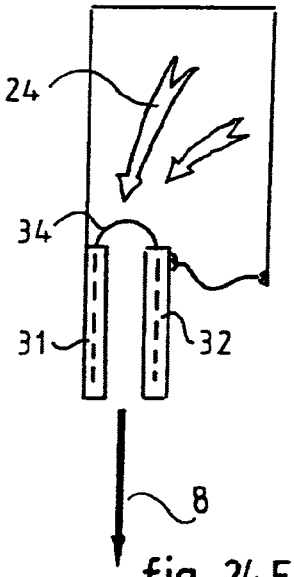
Figure 25A:
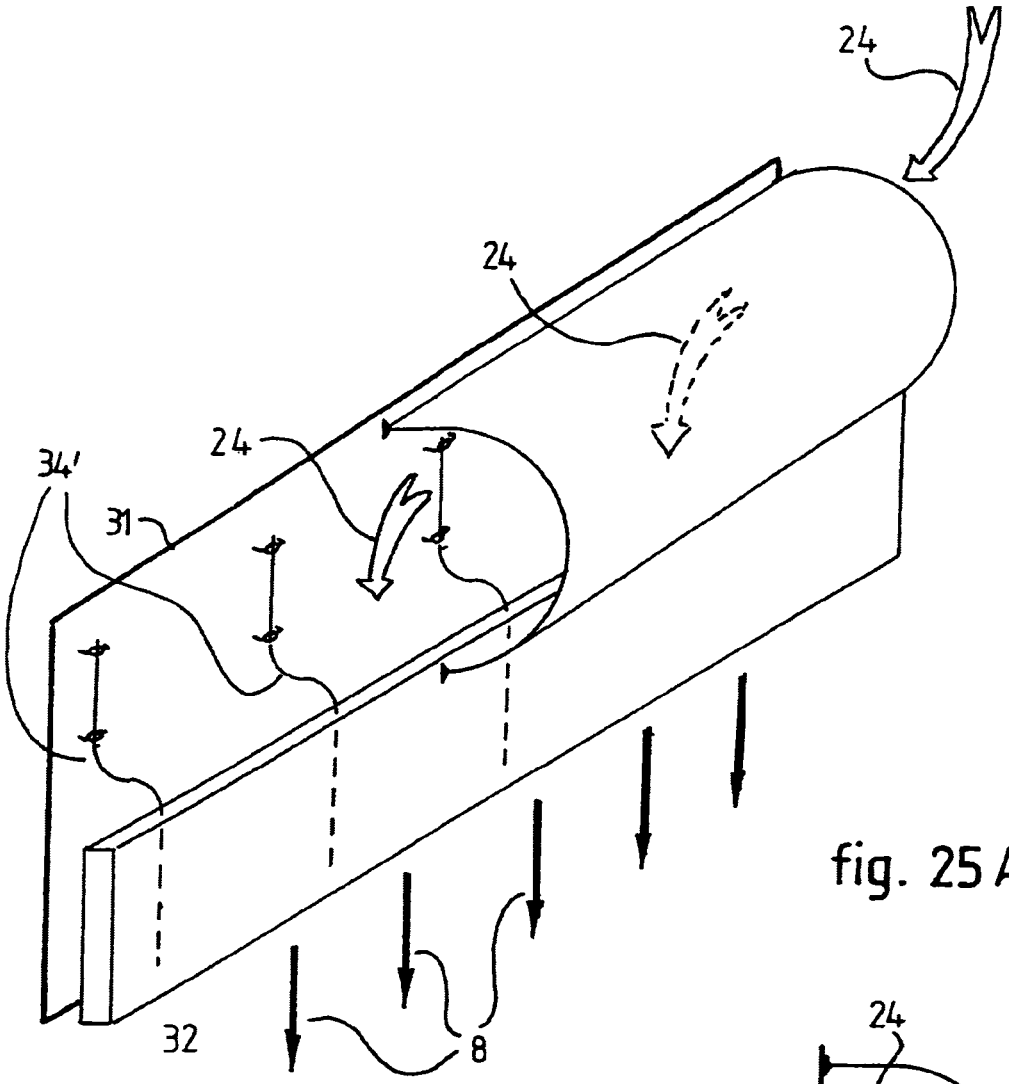
Figure 25B:
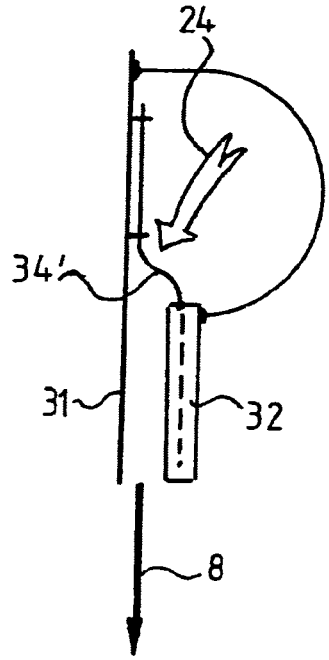

FIGS. 5B/6B show three mutually adjacent air streams with at least roughly the same width;

FIGS. 5C and 6C show the air streams with values indicated therein that are relevant to the invention;

FIGS. 5D/6D show the associated speed profiles;

FIGS. 7 and 8 show Mollier diagrams for the purpose of elucidating the manner in which condensation and icing are prevented according to the invention;

FIG. 9 shows an embodiment corresponding with FIG. 4, which is drawn in slightly more detail;

FIG. 10 shows the horizontal cross-section X-X in FIG. 9;

FIGS. 11, 12 and 13 show horizontal cross-sections through three different respective embodiments for the purpose of elucidating possible choices of the manner of flow of the primary and the secondary air streams;

FIG. 14 shows a view corresponding with FIGS. 5C/6C of two primary and two flanking, secondary air streams;

FIG. 14A shows an associated Mollier diagram;

FIG. 14B shows a schematic view of four mutually adjacent air streams as can occur in the embodiment according to FIG. 13;

FIG. 15A shows a schematic perspective view of the device according to FIG. 13;

FIG. 15B shows a view corresponding with FIG. 15A of a variant;

FIG. 16 shows a schematic horizontal cross-section corresponding with FIG. 11 of yet another embodiment;

FIG. 17 shows a highly schematic cross-section and block diagram of yet another embodiment;

FIG. 18 shows a horizontal cross-section through a variant with a filter for ice crystals;

FIG. 19 shows a schematic perspective view of a part of the device according to FIG. 18;

FIG. 20 shows a device according to the invention which displays a certain undesirable effect in the case a vehicle passes through;

FIG. 21 shows a view corresponding with FIG. 20 of a variant in which said problem has been solved;

FIG. 22A shows a schematic perspective view corresponding with FIG. 21 of a cold store with an assembly of two devices according to the invention;

FIG. 22B shows a view corresponding with FIG. 22A of a variant with an assembly of three devices according to the invention;

FIG. 23 show schematic horizontal cross-section through a further embodiment, in which use is made of an assembly of three devices according to the invention in accordance with FIG. 22B;

FIG. 24A shows a schematic perspective partial view of a blower unit, wherein the slit width is adjustable;

FIG. 24B shows a top view in the situation in which the slit width is maximal;

FIG. 24C shows a top view corresponding with FIG. 24B in the situation in which the slit width has been reduced;

FIG. 24D shows the cross-section XXIV according to FIG. 24A;

FIG. 24E shows a view corresponding with FIG. 24D of a variant;

FIG. 25A shows a view corresponding with FIG. 24A of yet another embodiment; and FIG. 25B shows a view corresponding with FIG. 24D of the variant according to FIG. 25A.

The temperatures and humidities indicated in the figures relate only to illustrative examples for the purpose of elucidating the invention. Practical, actual values may vary herefrom, even to a substantial extent.

Figure 1:
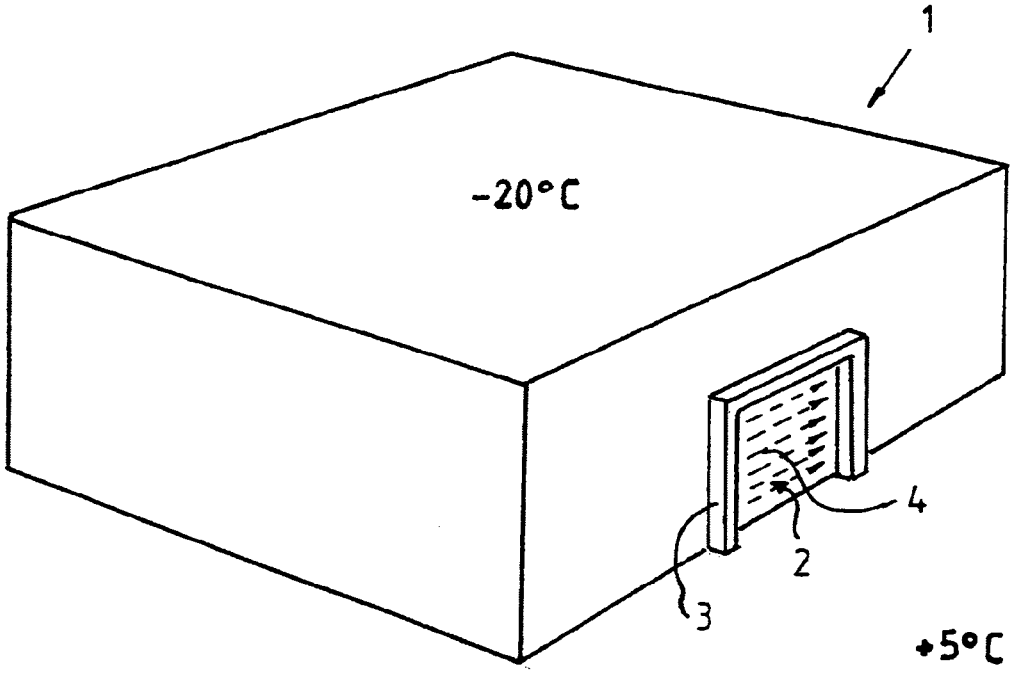
FIG. 1 shows a schematic perspective view of a cold store with an air wall device according to the invention.

FIG. 1 shows a cold store 1 with an internal temperature in the order of −20° C. The outside temperature, i.e. the temperature of the ambient air, amounts in this example to about 5° C. There is thus a difference in temperature of 25° C. between the air in the cold store and the outside air. A device 3 for generating an air wall 4 is added to a passage opening 2. This air wall, which will be described in more detail hereinbelow, comprises an at least more or less flat air stream which extends in a vertical plane and which moves in the drawing from the left-hand side of device 3 to the right-hand side of device 3. The relatively warm outside air is effectively separated from the cold inside air by this air stream, which has a substantial speed, i.e. a speed of at least 15 m/s, or more than 50 km/h. This separation relates to all relevant properties of the inside air and the outside air, in particular temperature and humidity.

Figures 1, 2A:
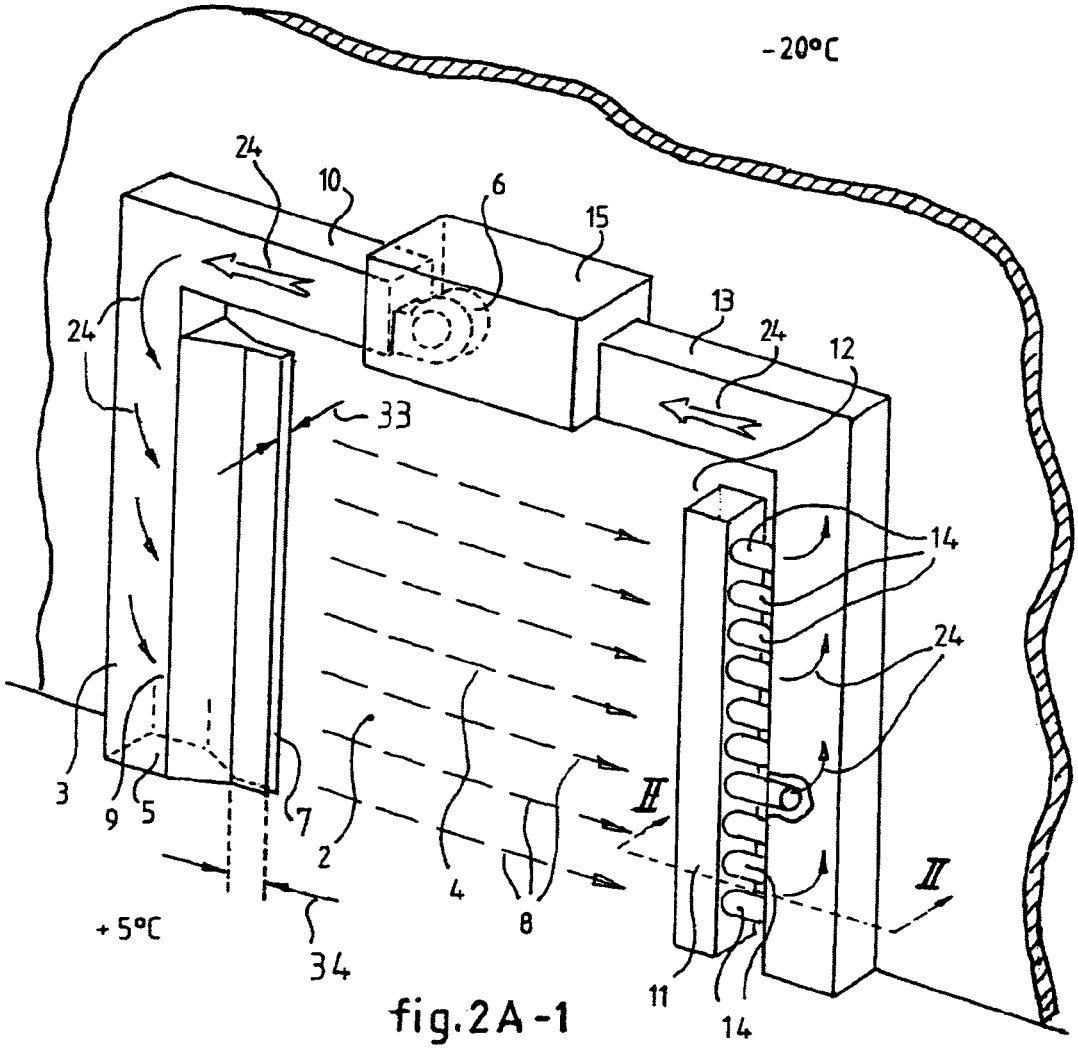
FIG. 2A shows a schematic perspective view of the air wall device according to FIG. 1.

FIG. 2A-1 shows device 3 in more detail. The device comprises a primary blower unit 5 positioned on one side of the passage opening and having a primary blower fan 6, which fulfils an additional function in the manner to be described hereinbelow, and a primary blower slit 7 which connects thereto on the blower side, is arranged substantially parallel to the main plane of passage opening 2 and extends over at least substantially the whole height of passage opening 2 for the purpose of generating the air stream, which is indicated with arrows 8 and forms air wall 4, this air stream being directed at the other side of passage opening 2.

The primary blower unit 5 comprises a cavity 9 which connects via a duct 10 to fan 6, to which cavity the primary blower slit 7 connects.

This slit has a width 33 of 10-30 mm and a length 34 of 20-40 cm in the direction of primary air flow 8.

The drawing shows that cavity 9 and the primary blower slit 7 have an at least more or less prismatic form.

Situated on the other side of passage opening 2 is a suction unit 11 with a suction slit 12, which in this embodiment is substantially prismatic. Suction slit 12 also connects to fan 6 via a second duct 13. There is therefore, as indicated with arrows 24 which show the air streams, a more or less closed circuit in portal 15, of which air stream 8 and thereby air wall 4 form part, and which is wholly generated and sustained by fan 6. Added to suction slit 12 are a number of passive control valves 14 which are uniformly distributed along the height such that the same air stream passes through at each height position. As a result the air in air stream 8 flows substantially horizontally at any height. Arrows 8 indicate this.

Figures 2, 2A:
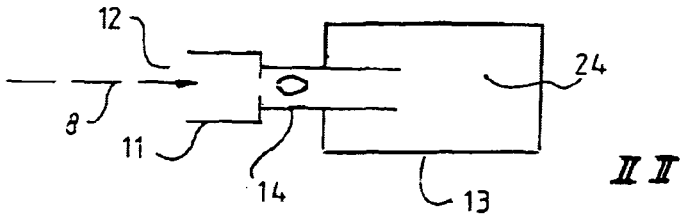

FIG. 2A-2 shows the cross-section II-II of FIG. 2A-1.

Figure 2B:
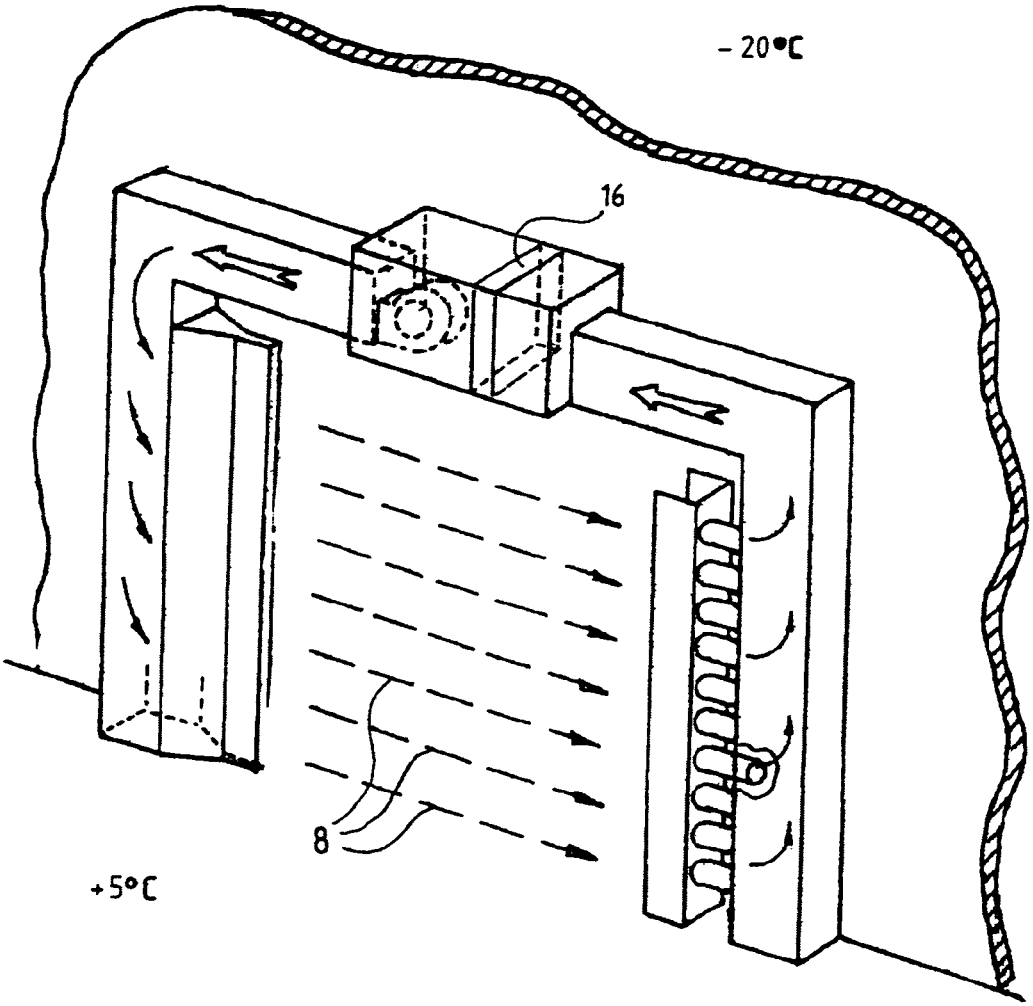
FIG. 2B shows a view corresponding with FIG. 2A of a variant.

FIG. 2B shows a variant in which a heating unit 16 is also accommodated in the portal 15 in which fan 6 is placed.

Figure 3:
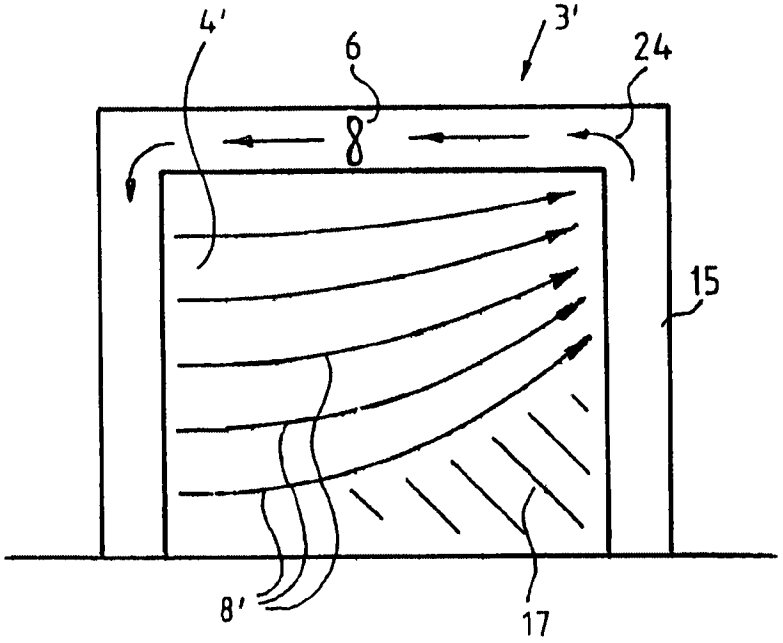
FIG. 3 shows a highly schematic front view of an air wall device which has a specific problem.

FIG. 3 shows a schematic view of device 3 which, in contrast to the embodiment according to FIG. 2A, is not provided with the passive control valves 14 for ensuring a constant airflow.

As FIG. 3 clearly shows, air wall 4' has a defect, i.e. an open space at the bottom right-hand side. This space is designated with 17. This is because the lowest part of air stream 8' has a strong tendency to move upward.

In contrast to FIG. 3, FIG. 4 shows that air flow 8 moves substantially wholly horizontally as a result of the action of the constant flow valves 14.

Figure 6:
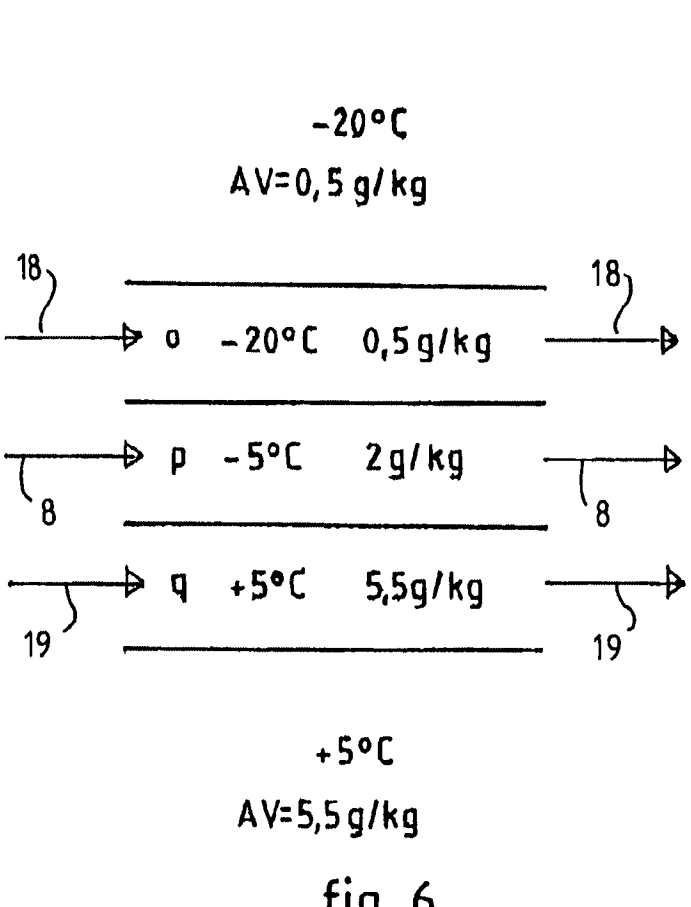
FIGS. 5 and 6 show schematic embodiments of an air wall with a primary air stream and two secondary air streams adjacent thereto and flowing at the same speed.

FIGS. 5 and 6 show schematically the configuration and parameter values in air wall 4. This comprises primary air stream 8 with a temperature of about −5° C. and an absolute humidity of 0.5 g/kg. This primary air stream 8 is heated relative to the internal space of cold store 1, which does after all have a temperature of −20° C., by the operation of heating unit 16.

Of great importance is the presence of two secondary air flows moving at the same speed on either side of primary air stream 8, i.e. a cold secondary air stream 18 and a warm secondary air stream 19. The cold secondary air stream 18 is situated on the inner side, has a temperature of −20° C. and an absolute humidity of 0.5 g/kg. This secondary air stream logically has the same temperature and humidity as the inside air in the cold store, it being after all an entrained air stream which has not been subjected in any way to any treatment or other intervention.

The same applies mutatis mutandis for the warm secondary air stream 19. This has the same temperature and absolute humidity as the ambient air, i.e. +5° C. and 5.5 g/kg.

Figure 6A:
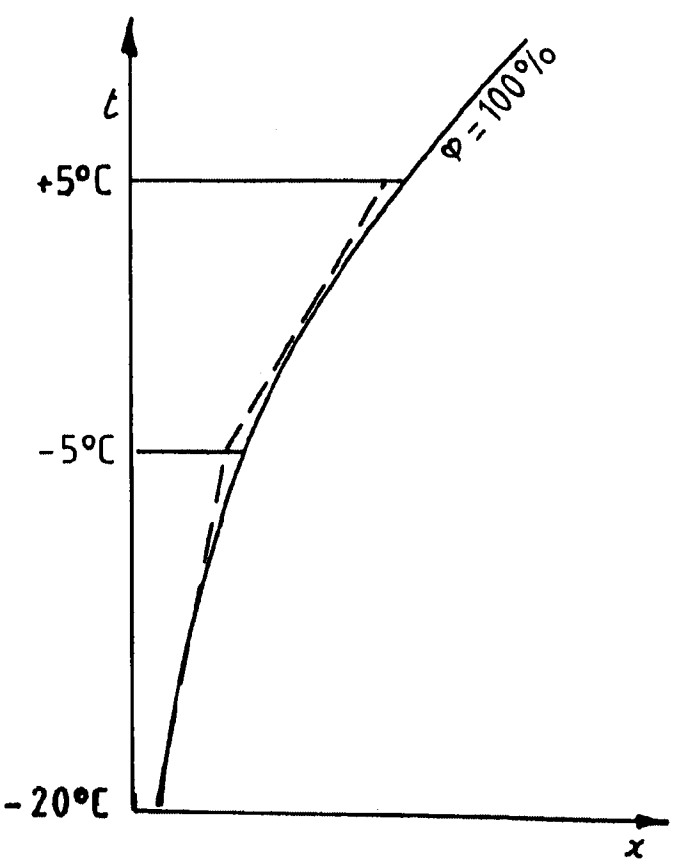
FIGS. 5A and 6A show Mollier diagrams corresponding with FIGS. 5 and 6.

FIGS. 5A and 6A (abscissa=absolute humidity x; ordinate=dry-bulb temperature t) show what the differences are. In FIG. 5A the line of action, indicated with a broken line, from −20° C. to −5° C., both with an AH=0.5 g/kg, is situated to the left of the saturation line, i.e. the line relative humidity RH=100%. This method of operation prevents the misting, provided of course that the temperature and the absolute humidity are maintained at the relevant values or at least do not pass over the saturation line.

In the situation according to FIG. 6A the line of action from −20° C., x=0.5 g/kg to −5° C., x=2 g/kg is situated on or just beyond the saturation line. Due to the speed of the two relevant air streams the line reaches the respective points A and B in the relevant case of FIG. 8. Depending on the relative difference in speed, for instance between the air wall with high speed and a stationary layer of air, wherein it is known that the air wall entrains air therefrom at high air speed, and all situations between, formation of vapour will begin to occur somewhere in the length direction according to FIG. 7.

The invention has for its object to operate the device such that possible formation of vapour occurs only after the other side of passage opening 2 has been passed through. For this purpose the air speed can be adjusted, in particular increased in the case of formation of vapour, or the absolute humidity at the flow of −5° C. can be reduced.

The temperatures and the absolute humidities are important in FIGS. 5, 5A, 5B, 5C and 6, 6A, 6B, 6C. The width of the air flow is important in FIGS. 5B and 6B (the same figures). For instance:

| | | | |
|---|---|---|---|
| o (18) | 12 mm | 10 mm | |
| p (8) | 15 mm | 10 mm | 20 mm |
| q (19) | 12 mm | 10 mm | |
| Total | 39 mm | 30 mm | 20 mm |

Tests yet to be carried out must demonstrate what the practical minimum dimension should be. It will be apparent that larger dimensions can be chosen than indicated above. It will be noted that more air is transported in the case of larger dimensions. A practical and economic value with eventually be determined on this basis. The values given for the widths in this specification are only specified for air stream p8.

The arrows between the lines or plates relate to the respective air speeds, for which only the data are also given for primary air stream p 8 in the claims and accompanying specification.

Secondary air streams o 18 and q 19 are the flanking, entrained air streams as shown in FIGS. 5C and 6C.

FIGS. 5D and 6D show very schematically a possible speed distribution 35.

A single air wall 4 has a certain strength for keeping the air masses in the adjacent spaces separated from each other. The inventors suspect that a composite layer of air according to FIGS. 5 and 6 must not be much wider than 3×30 mm in order to obtain the same strength. It is conjectured that, with a view to the separation of the composite air wall 18, 8, 19 at the air suction, the values according to FIGS. 5C and 6C will be the most successful.

FIG. 6 shows another embodiment in which primary air stream 8 has a different humidity, 2 g/kg. This value lies between the corresponding values of air streams 18 and 19.

FIG. 7 is a Mollier diagram which shows that, when warm air and cold air with substantially the same relative humidity mix, the saturation limit is passed and condensation such as misting and/or icing occurs.

FIG. 8 shows the same diagram in the situation where no mixing occurs. It is apparent that the occurrence of condensation is prevented in this situation.

FIG. 9 shows the schematic view of FIG. 4 in slightly more detail.

FIG. 10 shows that the air wall 8 from blower slit 20 (given a slightly different form in this embodiment) displays a certain divergence. In this respect suction slit 21 has an outward widening form whereby the divergent primary air stream 8 can also be wholly taken up.

FIG. 11 shows an embodiment in which use is made of a primary blower unit which generates a primary air stream on the outside.

FIG. 12 shows an embodiment in which a primary blower unit generates an air flow on the inside.

FIG. 13 shows an embodiment in which a primary blower unit generates two primary air streams 8.

All primary air streams in FIGS. 11, 12 and 13 entrain secondary air streams 18, 19.

FIG. 14 shows the properties of the four air streams 18, 8, 8, 19, given the fact that in this embodiment the inside temperature of the cold store amounts to −25° C. and the ambient temperature to +20° C.

FIG. 14A is the elucidation with Mollier diagram of FIG. 14. In this respect reference is also made to FIG. 6A. No condensation occurs.

FIG. 14B corresponds with FIG. 5C.

FIG. 15A shows an assembly 25 of two devices 3, 26. Reference is made to FIG. 3, which shows one such device 3.

The width 37 of an added secondary blower slit 36 is greater than that of the primary blower slit 33.

The embodiment according to FIG. 15B differs from that of FIG. 15A in that assembly 25 comprises two devices 3' and 26', in which respective heating units 16, 27 are added to the air circuit.

FIG. 16 shows an embodiment in which the relatively warm secondary air stream 19 is blown out through a secondary blower slit 36, which forms part of a secondary blower unit 39 which also heats the passing air stream.

FIG. 17 shows an embodiment in which the relatively cold secondary air stream 18 is collected by a secondary suction unit 40 which is provided along its height with secondary control valves 14 for a constant flow. For the purpose of optimal suction of the secondary air stream 18 use is made of a variable degree of opening. This is realized by a strip 41 which extends in vertical direction and which is connected to the secondary suction unit via a hinge 42. The angular position 43 of strip 41 can thus be adjusted in the drawn manner.

A heating unit 16 is added to fan 6 in the "cold circuit" 24. A cooling unit 45 is added to a fan 44 in the "warm circuit" 24'.

FIGS. 18 and 19 show a further development of the embodiment according to FIG. 12. In this embodiment a catching unit 127 for ice crystals is added to the device. This catching unit 127 comprises a filter with gauze, the mesh width of which lies in the order of 1 mm.

In order to remove ice crystals therefrom, catching unit 127 can for instance be subjected at regular intervals to an impact excitation, or use can be made of a brushing device. Such provisions are not drawn. They can operate automatically, for instance at regular intervals.

FIG. 20 shows schematically that air wall 4 is seriously disrupted when a vehicle 28 passes through passage opening 2. The air present in the right-hand zone 38 relative to vehicle 28 is in this embodiment on the leeward side and the air wall is there no longer effective. Zone 38 can thus be deemed a dead zone or leeward zone.

FIG. 21 shows a variant with which this is obviated. Positioned in this embodiment on the side of the suction unit is a second blower unit 29, the height of which roughly corresponds to the height of passing vehicles 28. This second blower unit 29 is set into operation by timely advance automatic opening of a valve 46 in a branch duct 47 for the purpose of admitting a partial flow 48 as a vehicle 28 approaches, and is rendered inoperative again once vehicle 28 has wholly passed through the area of passage opening 2. It will be apparent from FIG. 21 that the air stream is brought about in dead zone 38 by the operation of second blower unit 29, whereby air wall 4 remains at least substantially sealed.

FIG. 22 shows a cold store 1' with an inside temperature of −25° C., wherein the outside temperature amounts for instance to +10° C. In respect of the great temperature difference to be bridged, use is made of an assembly 30 of two devices 3.

FIG. 23 shows a highly schematic cross-section through assembly 31 according to FIG. 22B. As FIG. 23 clearly shows, assembly 31 comprises three devices 3, the middle device of which has a blow-in direction which is opposite to that of the other two devices. Vortex-like secondary air streams 18, 19 and 19, 18 respectively are thus generated in the cells bounded by the relevant primary air streams 8, 8, 8.

Using this arrangement according to FIG. 23 a very great temperature difference, i.e. of for instance 50° C., can be effectively bridged over a distance of several meters with an extremely low equivalent coefficient of heat transfer.

FIG. 24 shows that, by making use of two mutually displaceable strips 31, 32, the distance between these strips 31, 32 can be varied, whereby the width of the primary or secondary blower slit can be changed. For this purpose strips 31, 32 connect airtightly to a flexible, subdivided blower tube 33. FIGS. 24B and 24C show particularly the manner in which, due to hinge connections 34, strips 31, 32 are displaceable parallel to each other and their mutual distance can vary.

FIGS. 25A and 25B show a variant.

CITED LITERATURE

U.S. Pat. No. 6,106,387
U.S. Pat. No. 3,143,952
DE-A-199 32 708
DE-A-103 20 490
NL-C-102 43 46

The invention claimed is:

1. A device (3) for generating an air wall (4) for thermal separation of the air in a first relatively cold space (1) from the air in a second relatively warm space, which spaces are mutually connected by a passage opening (2), the device (3) comprising:

a primary blower fan means (6), a primary blower unit (5) positioned on one side of the passage opening (2), substantially parallel to a main plane of said passage opening (2) and extending over a relevant dimension of said passage opening (2), said primary blower unit (5) having a primary blower slit (7) of a given length and width which receives an air stream from said primary blower fan means, said primary blower unit (5) arranged for generating an at least more or less flat primary air stream (8) directed at least roughly toward an opposite side of said passage opening (2);

wherein said primary blower fan means (6) generates an air speed in the primary air stream (8) of at least 30 m/s; and the width of the primary blower slit (7) lies in the range of 15-40 mm;

wherein the device (3) further comprises:

a suction unit (11) positioned on an opposite side of the passage opening and having a suction slit (12) extending substantially parallel to the blower slit (7) and having a length which is substantially the same as the given length of the primary blower slit (7), said suction slit (12) subjected to an air stream directed as said primary air stream;

a row of control valves (14) located in the suction slit (12), said control valves (14) distributed along an extent of said suction slit (12) so as to obtain a substantially constantly passing airflow;

wherein a length of the primary blower slit 7) in the direction of the air stream lies in the range of 5-40 cm a secondary blower unit (39) with a secondary blower slit (36) which connects thereto on the blower side, disposed adjacently of the primary blower slit and having the same length as the primary blower slit, and a heating unit (16) arranged to change a temperature of air blown out by the secondary blower slit (36) slit.

2. The device (3) according to claim 1, wherein the primary blower unit (5) further comprises:

a cavity (9) to which the primary blower slit (7) connects, said cavity having a cross-sectional area in the range of 400 $cm^2$ to 2000 $cm^2$.

3. The device (3) according to claim 1, wherein the primary blower slit (7) is connected via a duct (10, 13) to the suction slit (12), in which duct the primary blower fan means (6) are disposed.

4. The device (3) according to claim 1, which further includes a catching unit (127) for ice crystals, wherein said catching unit (127) is placed in the downstream zone of the primary outflow and includes a filter with a mesh of 0.4 to 2 mm.

5. The device (3) according to any of claims 1-3 and 4, wherein the device (3) comprises a generally tubular, hollow portal (15), with the general form of an open U with two legs, one leg of which has a blower slit (7) and another leg a suction slit (12).

6. The device (3) according to claim 5, wherein the fan means (6) are present in a hollow portal (12) in an air circuit (24) between the slits (7, 12).

7. An assembly (30) of at least two devices (3) according to any of claims 1-3 and 4, which assembly (30) is disposed in a transit tunnel which connects sealingly to the passage opening (2), in which assembly (30) adjacent primary air streams (8) have opposing directions.

8. A method for generating an air wall (4) for thermal separation of the air in a first relatively cold space (1) from the air in a second relatively warm space, which spaces are mutually connected by a passage opening (2), the method comprising:

providing;

a primary blower fan means, a primary blower unit (5) positioned on one side of the passage opening (2) and having a primary blower slit (7) of a given length and width which connects thereto on the blower side, said primary blower unit (5) being disposed substantially parallel to a main plane of the passage opening (2) and extending over a relevant dimension of the passage opening (2), and a suction unit (11) positioned on the opposite side of the passage opening (2) and having a suction slit (12) extending parallel to the blower slit (7) and having the same length as the primary blower slit (7), the suction slit (12) having a row of control valves (14) distributed along an extent of said suction slit (12), said primary blower fan means generating an at least more or less Out primary air stream (8) directed at least roughly toward the opposite side of the passage opening (2);

said suction slit subjected to an air stream directed as said primary air stream, providing two secondary air streams Ss1 (18) and Ss2 (19) in addition to the primary air stream (8) on either side thereof, which secondary air streams (18, 19) have substantia the same direction as the primary air stream (8);

$Ts1<Tp<Ts2$, wherein:

Ts1=the temperature of the secondary air stream (18) on the side of the relatively cold space (1), Tp=the temperature of the primary air stream (8), and Ts2=the temperature of the secondary air stream (19) on the side of the relatively warm space;

$Avs1 \leq AVp<AVs2$, wherein:

AVs1=the absolute humidity of the air in the secondary air stream (18) on the side of the relatively cold space (1);

AVp=the absolute humidity of the air of the primary air stream (8), and

AVs2=the absolute humidity of the air in the secondary air stream (19) on the side of the relatively warm space;

wherein:

the speed of the air in the primary air stream (8) amounts to at least 15 m/s; and the width of the primary blower slit (7) lies in the range of 15-40 mm; and the length of the primary blower slit (7) in the direction of the air stream (8) lies in the range of 5-40 cm.

9. The method according to claim 8, further comprising:

actively generating at least one of the secondary air streams (19) by a secondary blower unit (39) with secondary blower fan means and a secondary blower slit (36) which connects thereto on the blower side, the secondary blower slit (36) being disposed adjacently to the primary blower slit (7) and having the same length as the primary blower slit (7).

10. The method according to claim 9, further comprising changing the temperature and/or the humidity of the air blown out by the secondary blower unit (39).

11. The method according to claim 9, further including:

providing a second blower unit (29) on the side remote from the primary blower unit (5) which has a height corresponding to the height of passing vehicles (28), the method further comprising:

setting the second blower unit into operation when a vehicle (28) approaches and rendering the second blower unit inoperative after the vehicle (28) has wholly passed through the area of the passage opening (2).

12. The method according to any of claims 8-11, wherein the primary blower unit (5) is arranged vertically, such that the air wall (4) traverses the passage opening (2) in a horizontal direction.

13. The device (3) according to claim 1, wherein the primary blower slit and the secondary blower slit are spaced a maximum distance of 3 mm.

14. The device (3) according to claim 1, wherein said suction slit has a width and is disposed such that it suctions substantially only the primary air stream.

* * * * *